US005372518A

United States Patent [19]

Liu et al.

[11] Patent Number: 5,372,518

[45] Date of Patent: Dec. 13, 1994

[54] ELECTRICAL CONNECTOR WITH IMPROVED LATCH MECHANISM

[75] Inventors: Chao J. Liu, Chang Hus Hsien; Ching-ho Lai, Taipei Hsien; Jeff Chen, Shin-Juu, all of Taiwan, Prov. of China; Sidney Lu, Sunnyvale, Calif.; Ton-Yo Chien, Pan Chiao, Taiwan, Prov. of China

[73] Assignee: Foxconn International, Sunnyvale, Calif.

[21] Appl. No.: 123,241

[22] Filed: Sep. 16, 1993

Related U.S. Application Data

[62] Division of Ser. No. 745,609, Aug. 15, 1991, Pat. No. 5,286,217.

[51] Int. Cl.[5] ..... H01R 13/52

[52] U.S. Cl. ..... 439/326; 439/350

[58] Field of Search ..... 439/326–328, 439/350–358, 341, 372, 636, 637

[56] References Cited

U.S. PATENT DOCUMENTS 4,713,013 12/1987 Regnier et al. .
4,737,120 4/1988 Grabbe et al. .
4,850,892 7/1989 Clayton et al. .
4,898,540 2/1990 Saito .
4,986,765 1/1991 Korsunsky et al. .
4,995,825 2/1991 Korsunsky et al. .
5,002,498 3/1991 Takahasi .
5,004,429 4/1991 Yagi et al. .
5,013,257 5/1991 Korsunsky et al. .
5,094,624 3/1992 Bakke ..... 439/326
5,112,242 5/1992 Choy et al. ..... 439/328
5,174,780 12/1992 Yang Lee ..... 439/326
5,244,403 9/1993 Smith et al. ..... 439/326

*Primary Examiner*—David L. Pirlot
*Attorney, Agent, or Firm*—Flehr, Hohbach, Test, Albritton & Herbert

[57] ABSTRACT

A circuit board latching device (40, 41) for use with an insulative connector housing (31) includes a retaining wall (82) and a circuit board support post (52) in which the board support post (52) is positioned opposite the retaining wall (82). The latching device (40, 41) of the present invention comprises a main body portion (56) and a mounting mechanism for mounting the main body portion to the housing (31) between the retaining wall (82) and the board support post (52). Furthermore, a latch lug (71) extends from the main body portion (56) which includes a cam surface (72) which is inclined relative to the latch lug (71), and a lock surface (73) which is substantially perpendicular to the main body portion (56). Moreover, the latching device (40, 41) includes a resilient stress reducing arm (79) projecting angularly away from the main body portion (56) toward the retaining wall (82). In one aspect, the mounting mechanism comprises a mounting platform (94) which includes a plate (106) extending from the main body portion (56). A first finger (95) extends substantially downward from one end of the plate (106) while a second finger (96) extends substantially downward from the opposite end of the plate (106) which mountingly engage the housing (31). In another aspect of the present invention, the mounting mechanism comprises an upstanding sleeve (59) mounting member extending from the main body portion (56).

37 Claims, 14 Drawing Sheets

30-8
75b-8
71b-8
78b-8
52b-8
56b-8
58b-8
31-8
74b-8
94b-8
107b-8
79b-8
45-8
82b-8
106b-8
109b-8
33-8
43b-8
96b-8
41-8

41-8
56b-8
75b-8
58b-8
106b-8
51b-8
97b-8
108b-8
110b-8
43b-8
31-8
30-8
79b-8
56b-8
94b-8
51b-8
96b-8
107b-8
109b-8

75b-8
79b-8
78b-8
56b-8
106b-8
97b-8
108b-8
58b-8
107b-8
42-8
71b-8
56b-8
94b-8
96b-8

55b-6
78b-6
52b-6
30-6
31-6
74b-6
15
41-6
79b-6
45-6
56b-6
94b-6
43-6
33-6
96b-6

79b-6
41-6
56b-6
94b-6
97b-6
124b-6
31b-6
99b-6
30b-6
106b-6
122b-6
96b-6
98b-6

ELECTRICAL CONNECTOR WITH IMPROVED LATCH MECHANISM

This is a division, of application Ser. No. 7/745,609 filed Aug. 15, 1991 now U.S. Pat. No. 5,286,217.

BACKGROUND OF THE INVENTION

1. Field of the Invention

The present invention relates to electrical connectors, and more particularly, to electrical connectors which incorporate a metal latch mechanism.

2. Description of the Related Art

Generally, main circuit boards or "motherboards" employed in computers or other electrical equipment are interconnected to an array of secondary circuit boards. There are numerous types of secondary boards such as edge cards, single in-line packages (SIP), memory modules, a single in-line memory modules (SIMM) or circuit modules. Circuit boards ordinarily comprise a rigid substrate board having a plurality of integrated circuits mounted thereon.

Often, interconnection between a main circuit board and a secondary board is provided through an electrical connector mounted to the main circuit board. These connectors ordinarily include an insulative housing defining an elongated slot which houses a plurality of electrically conductive terminals. The secondary board is inserted into the slot so as to electrically contact the respective terminals. The board is then rotated to its operating position wherein the secondary board generally engages at least two latches disposed on opposing sides of the housing slot. These latches typically provide a contact portion which releasably secures the secondary board in the operational position.

In the past, metal latches have been removably installed at opposing ends of the elongated edge receiving slot in order to secure the secondary board in place.

These earlier metal latches serve as spring members in which bending forces typically are concentrated in a limited region of the latch. Unfortunately, virtually the entire bending forces are absorbed by the latch in that limited region.

Thus, there has been a need for a metal latch for use in an electrical connector which can distribute bending forces experienced by the latch. The present invention meets this need.

SUMMARY OF THE INVENTION

In one aspect, the present invention includes a circuit board latching device for use with an insulative connector housing which includes a retaining wall and a circuit board support post in which the board support post is positioned opposite the retaining wall. The latching device of the present invention comprises a main body portion and a mounting mechanism for mounting the main body portion to the housing between the retaining wall and the board support. Furthermore, a latch lug extends from the main body portion which includes a cam surface which is inclined relative to the latch lug, and a lock surface which is substantially perpendicular to the main body portion. Moreover, the latching device includes a resilient stress reducing arm projecting angularly away from the main body portion toward the retaining wall.

In another aspect of the present invention, the mounting mechanism comprises an upstanding sleeve mounting member extending from the main body portion.

In still another aspect of the present invention, the mounting mechanism comprises a mounting platform which includes a plate extending from the main body portion. First and second fingers extend downward from the plate to engage the housing.

DETAILED DESCRIPTION OF THE PREFERRED EMBODIMENT

Reference will now be made in detail to the preferred embodiments of the invention. While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Figure 1:
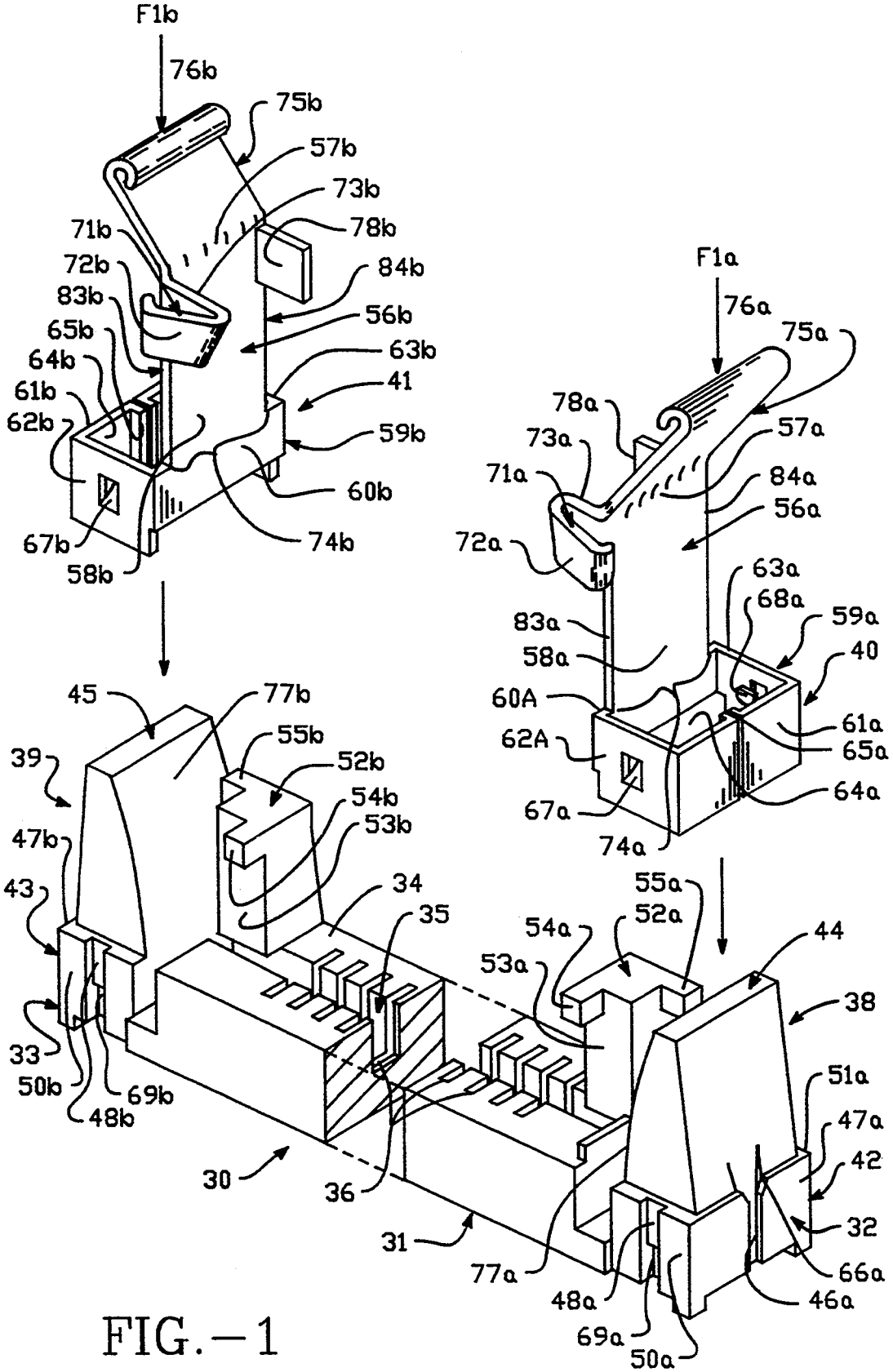
FIG. 1 is a fragmentary, top perspective view of the components of a electrical connector assembly in accordance with the present invention.

It will be noted here that for a better understanding, like components are designated by like reference numerals throughout the various figures. Attention is directed to FIG. 1, where the subject electrical connector, designated 30 is illustrated. In the preferred embodiment, there is shown the connector in accordance with the present invention which comprises an elongated insulative housing 31 including a first housing end 32, an opposing second housing end 33 and a top side 34 which defines a board-edge slot 35 formed in the top side 34. Slot 35 is dimensioned to slidably receive the board-edge device (not shown) of the secondary circuit board (not shown and which forms no part of the present invention). Further, when the secondary circuit board is mounted in its operating position, it will be appreciated that the secondary circuit board lies in a substantially vertical slot plane (not shown) which intersects the housing 31 along the elongated slot 35.

A plurality of electrically conductive terminals 36, are positioned inside slot 35 to engage respective conductive pads (not shown) disposed on the board-edge device. Situated at the first and second opposing housing ends 32 and 33 of the housing 31 and of the elongated slot 35, are a pair of removable latches 40 and 41 which are dimensioned to engage a side edge (not shown) of the secondary circuit board such that the board is releasably secured in its operating position in the slot 35 of the electrical connector 30.

As may be viewed in FIG. 1, a first support post 38, dimensioned to retain a first removable latch 40, upstands from the first housing end portion 32 of housing 31. Similarly, a second support post 39 is dimensioned to retain a second removable latch 41 and upstands from the second housing end portion 33 of housing 31. The respective support posts 38 and 39 comprise a generally rectangular base portions 42 and 43 and respective backstop portions 44 and 45.

Disposed on a respective outermost base rear wall 47*a*, as illustrated in FIG. 1, is a respective guidance slot 46*a*. A similar guidance slot (not visible) is formed in the opposite base near wall 47*b*. Base portions 42 and 43, further, define respective first and second vertical retaining slots 48*a*, 48*b* and 49*a*, 49*b* (not shown) positioned on respective first and second opposing base side walls 50*a*, 50*b* and 51*a*, 51*b* (not shown) of respective base portions 42 and 43.

Figure 2C:
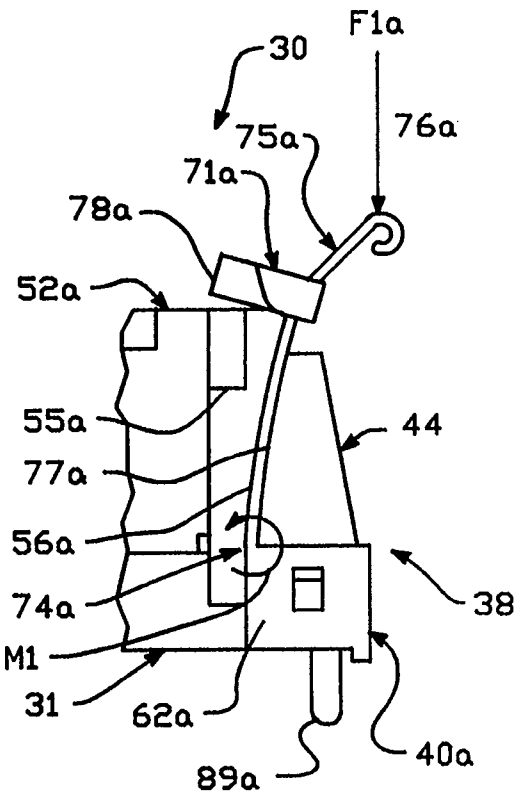
FIGS. 2A through 2C show a series of vertical sectional views of the electrical connector assembly of FIG. 1 at various stages of operation as the removable latch of the present invention is deflected rearward.
Figure 2B:
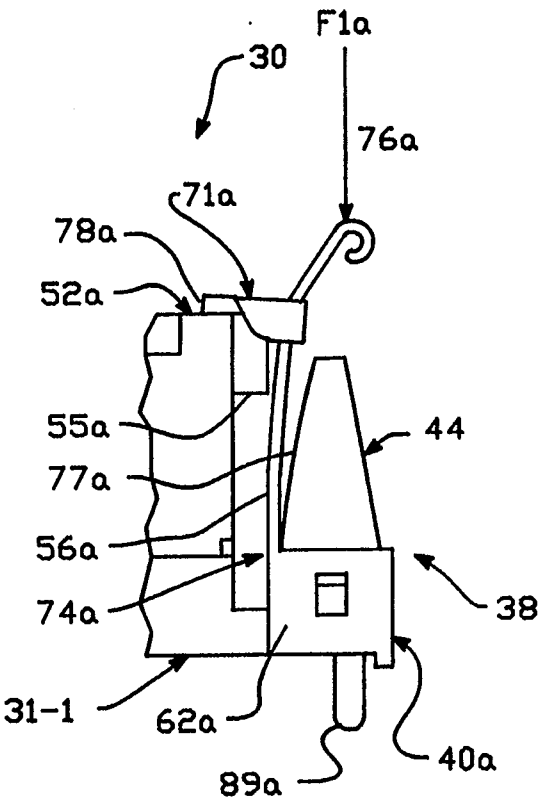
Figure 2A:
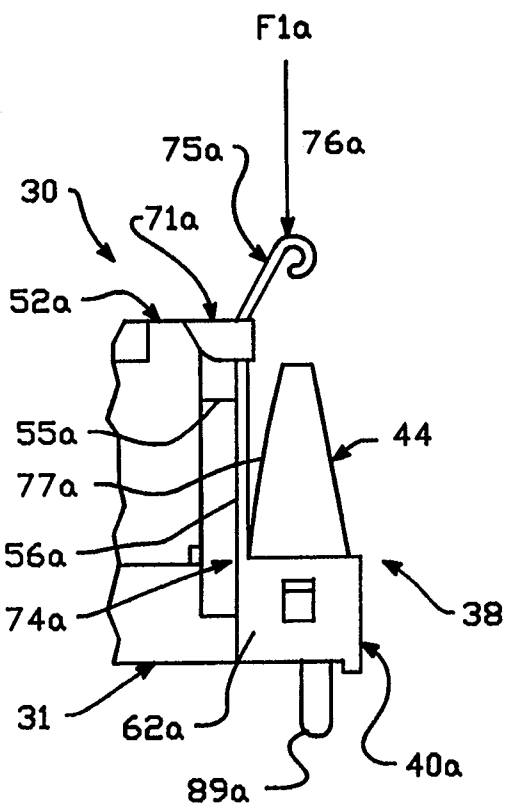

Referring to FIGS. 2A–2C, the electrical connector 30 of the present invention is mounted to the primary circuit board by respective housing mounting posts 89*a* and 89*b* extending downward from the bottom of the respective base portions 42 and 43. The housing mounting post 89*a* is illustrated which is integrally molded into the housing 31 and can extend through a correspondingly dimensioned aperture defined in a primary circuit board (not shown) to allow mounting thereon.

Extending upward from the top side 34 of the housing 31 is a first upstanding rear circuit board support 52*a* which includes a respective substantially vertical wall 53*a* disposed adjacent the board-edge slot 35. As viewed in FIG. 1, the first board support post 52*a* is positioned proximate the first housing end 32, but remains positioned between the first and second support posts 38 and 39. The first board support post 52*a* is substantially rigid and inflexible in response to the forces exerted against the respective vertical wall 53*a* during the secondary circuit board's rotation to its operating position. Thus, the respective vertical wall 53*a* acts as a seat against which the rear face (not shown) of the secondary circuit board rests against while retained in its operating position.

Additionally, protruding perpendicularly outward from the respective vertical wall 53*a*, in a direction perpendicular to the vertical slot plane, is a respective alignment post 54*a*, which is aligned for engaging a correspondingly dimensioned aperture (not shown) through the secondary circuit board. When the respective alignment post 54*a* is inserted into the respective aperture, the alignment post 54*a* causes the secondary circuit board to be both accurately positioned relative to the terminals 36 and to prevent improper or unintended withdrawal from the electrical connector 30. Projecting outward from the first board support post 52*a* is a respective latch front stop 55*a* which extends in a direction toward the first support post 38. In operation, a portion of the respective first latch 40 will be contacted and prevented from extending beyond the respective latch front stop 55*a*. The respective latch front stop 55*a* prevents the respective first latch 40 from over-extending beyond the stop.

A second board support post 52*b*, substantially symmetrical to the first board support post 52*a*, is positioned proximate the second housing end 33 of housing 31. As can be seen, this mirror-image structure is disposed on the opposite end of the elongated board-edge slot 35 and includes an identical structure which performs the identical functions as the first board support post 52*a*.

As previously mentioned and as can be seen in FIG. 1, the first and second removable latches 40 and 41 are positioned at the respective first and second housing opposing ends 32 and 33, which are, further, disposed at opposite ends of elongated board-edge slot 35. Further, the metal latches 40 and 41 are resilient. Moreover, it will be appreciated that the second latch 41 is symmetrical to, and a mirror-image of, the first latch 40. Henceforth, only the first latch 40 corresponding to the first housing end will be described in detail herein for the ease of description.

The resilient latch 40 comprises a main body portion 56*a* which includes a top portion 57*a*, and a bottom portion 58*a*. Integral with the bottom portion 58*a* is an upstanding rectangular sleeve portion 59*a* which includes a substantially vertical sleeve front wall 60*a*, a sleeve rear wall 61*a* and a respective first and second opposing sleeve side walls 62*a*. As shown, in this first embodiment, the bottom portion 58*a* of the main body 56*a*, is mounted atop the sleeve front wall 60*a*. The respective walls (i.e., the front rear and opposing sides), collectively, define an interior portion 64*a* which is dimensioned to snugly receive the base portion 42 of the support post 38.

Thus, it will be appreciated that upon assembly of the electrical connector 30 of the present invention, the base portion 42 is inserted into the interior portion 64*a* of sleeve portion 59*a*, wherein a respective latch alignment edge 65*a*, which protrudes into the interior portion 64*a* from the sleeve back wall 61*a*, engages the guidance slot 46*a* to assure proper alignment. Moreover, a mouth portion 66*a* of the guidance slot 46*a* is inclined outward so as to facilitate the engagement of the alignment edge 65*a* with the guidance slot 46*a*.

Respective first and second barb members 67*a* and 67*b* are opposingly positioned and protruding into the interior portions 64*a* from the opposing sleeve side walls 62*a* and 63*a*. Further, the barbs 67*a* and 68*a* are positioned to correspondingly engage the respective retainment slots 48*a* and 49*a* which are constructed to reduce the resistance force of the respective first and second barbs 67*a* and 68*a* against the respective first and second base side walls 50*a* and 51*a* during installation.

As illustrated in FIG. 1, the step portions 69*a* and 70*a* are defined by the respective base portion 42 to provide a means for securing the first latches 40 to the insulative first housing end 32. The respective first and second step portions 69*a* and 70*a* are positioned deeper into the base portion 42 which allows the respective barbs 67*a* and 68*a* to retainably engage therewith. Thus, the respective first and second barbs 67*a* and 68*a* slide along the respective retaining first and second slots 48*a* and 49*a* until they engage the respective first and second step portions 69*a* and 70*a*, thereby retaining the latch 40.

Accordingly, after assembly, when the sleeve portion 59*a* snugly engages the base portion 42, the first latch member 40 is removably secured to the housing 31 such that the base portion 42 provides adequate lateral support to retain the secondary circuit board in its operational position in electrical connector 30.

The first latch 40 includes a latch lug 71*a* coupled to a respective first main body edge 83*a* which faces the rotating circuit board. As shown in FIG. 1, the latch lug 71*a* is, further, preferably positioned proximate the top portion 57*a*. The latch lug 71*a* includes a camming wall 72*a*, which is formed to engage the first side edge (not shown) of the secondary circuit board upon rotational assembly, and respective retaining arm 73*a*, which is formed to removably retain the secondary circuit board in its operating position. The substantially planar retaining arm 73*a* extend outward from, and is each substantially perpendicular to, the main body portion 56*a*. Further, the retaining arm 73*a* extends inwardly toward the opposing latch 41, as shown in FIG. 1. The respective camming wall 72*a* is inclined rearwardly at an angle away from distal end of each retaining arm 73*a* in a direction towards the sleeve rear wall 61*a*.

As the secondary circuit board is rotated in the slot 35 to its secured operating position, a first board side edge engages the camming wall 72*a* of the latch lug 71*a*. During engagement, ramping forces urge the main body portion 56*a* rearward in a direction toward the sleeve rear wall 61*a*.

As the main body portion 56*a* is urged rearward, a bending moment is created and is generally concentrated at a resilient spring juncture 74*a*. This spring juncture 74*a* represents the intersection between the main body bottom portion 58*a* and the sleeve front wall 60*a*. Moreover, it will be appreciated that the spring juncture 74*a* is resilient.

As mentioned, upon rotational engagement with the first board side edge of the secondary circuit board, the main body portion 56*a* is deflected rearward until the first board side edge clears the distal end of the retaining arm 73*a*, whereby the spring juncture 74*a* resiliently urges the main body portion 56*a* forward in a direction toward the latch front stop 55*a*. Subsequently, the planar retaining arm 73*a* engages a rear surface of the secondary circuit board, thereby retaining the secondary circuit board in an operating position.

A respective latch plate 78*a* extends outwardly from the main body portion 56*a* in substantially the same direction as the retaining arm 73*a*. However, as shown in FIG. 1, the latch plate 78*a* is coupled to a second main body edge 84*a* of the main body portion 56*a* opposite the first main body edge 83*a*. As best viewed in FIGS. 2A–2C, when the first latch 40 is urged backwards or forwards (i.e., when a secondary circuit board is rotatably installed or removed), the latch plate 78*a* slidably engages a side portion of the latch front stop 55*a* of the first board rear support 52*a*. This engagement provides additional guidance to the main body portion 56*a* during movement, as well as providing lateral stability to the latch 23.

Angularly extending away from the top portion 57*a* of the main body portion 56*a* is a cantilever lever 75*a*, as shown in FIG. 1. The cantilever lever 75*a* extends angularly rearward in the direction back toward the retaining portion 44.

Referring back to FIGS. 1 and 2A–2C, a downward force (F1*a*), generally in the direction of arrow 76*a* applied on the cantilever lever 75*a* urges the main body portion 56*a* rearward in a direction toward the rear sleeve wall 61*a*. This retracts the wedge-shaped portion 71*a* from engaging the rear surface of the secondary circuit board; thus permitting the secondary circuit board to be removed from the elongated board-edge slot 35. Moreover, a resistant and opposing bending moment (M1), shown in FIG. 2(C), acting on the spring juncture 74*a* which urges the main body portion 56*a* back toward the latch front stop 55*a*.

As previously mentioned, a backstop portion 44 is positioned atop the support post 42. As best viewed in FIGS. 1 and 2A–2C, the retaining portion 44 include support backstop wall 77*a* which faces toward the first latch 40. Further, the support backstop wall 77*a* is slightly curved so that when the force (F1*a*) is applied to the cantilever lever 75*a* and the main body portion 56*a* is resiliently urged respectively rearward, it will contact substantially all the support backstop wall 77*a*.

Thus, the curved backstop wall 77*a* fits the motion orbit of the main body portion 56 when the same is urged rearward. Accordingly, the backstop wall 77*a* prevents the main body portion 56*a* from being over-extended in the rearward direction. This greatly diminishes permanent deformation at the spring juncture 74*a*.

Henceforth, each of the next alternative embodiments will only be referenced with respect to one, housing end, 32 or 33, and the respective corresponding latch, 40 or 41, for the ease of description. It will be appreciated, however, that the opposing end is substantially, structurally similar, but is a mirror-image of the described component.

Referring now to FIGS. 3, 4 and 5A–5C, an alternate embodiment of the present invention is illustrated. As shown, a stress reducing arm 79*a*-1 extends downward from top portion 57*a*-1 of the main body portion 56*a*-1. As will be described in greater detail below, the stress reducing arm 79*a*-1 reduces the bending stress concentrated at spring juncture 74*a*-1.

Figure 3:
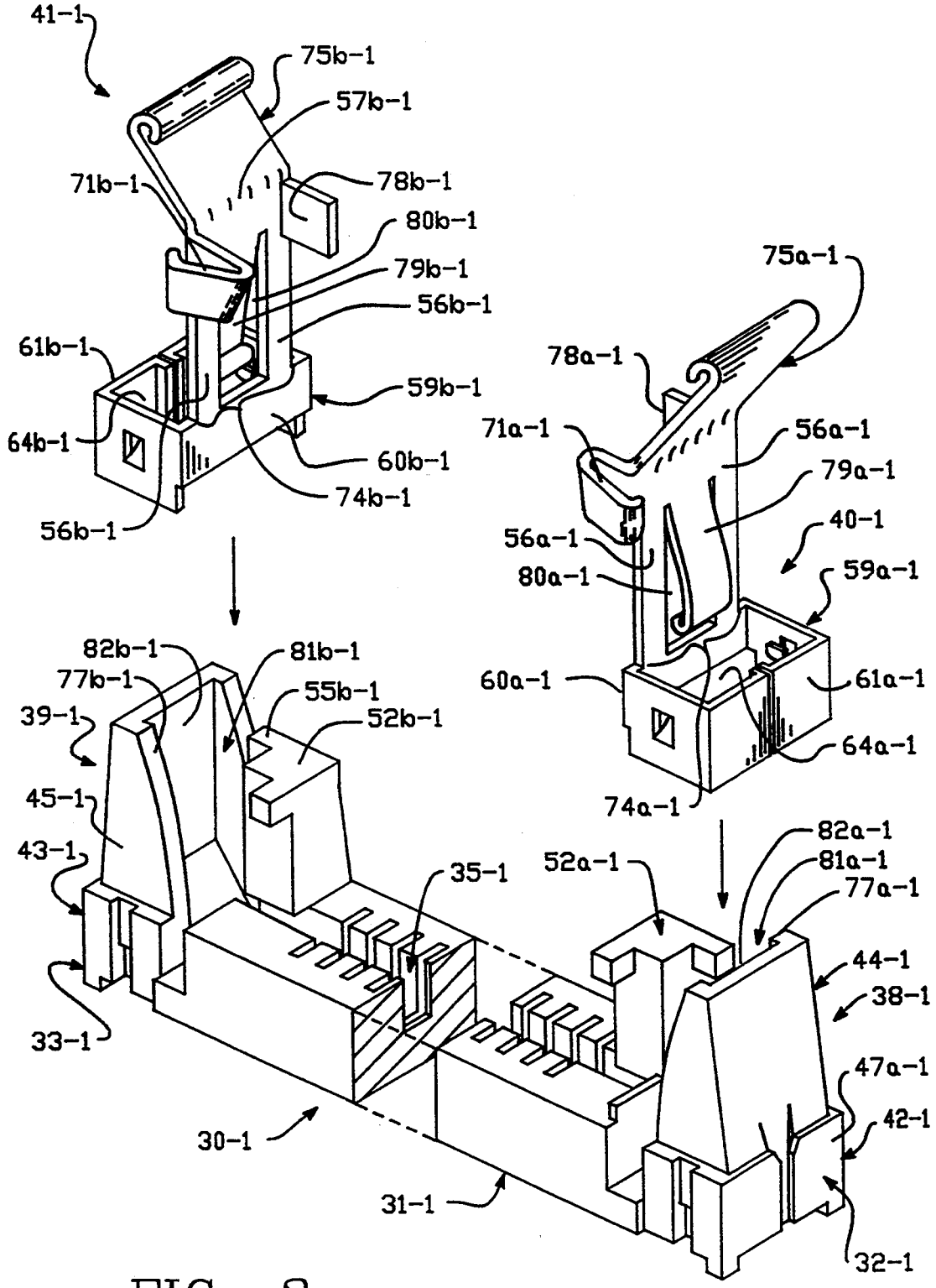
FIG. 3 is a fragmentary, top perspective top view of an alternative embodiment of electrical connector assembly in accordance with the present invention illustrating a stress reducing arm.

As best viewed in FIG. 3, the respective moment reducing arms 79*a*-1 and 79*b*-1 preferably are centrally positioned and extend substantially the vertical length of the respective main body portions 56*a*-1 and 56*b*-1. The stress reducing arm 79*a*-1 is angled rearwardly in the direction toward sleeve rear wall 61*a*-1. Further, the main body portion 56*a*-1 defines an arm slot 80*a*-1 in which the stress reducing arm 79*a*-1 is free to extend through during deflection of the main body 56*a*-1.

Figure 4:
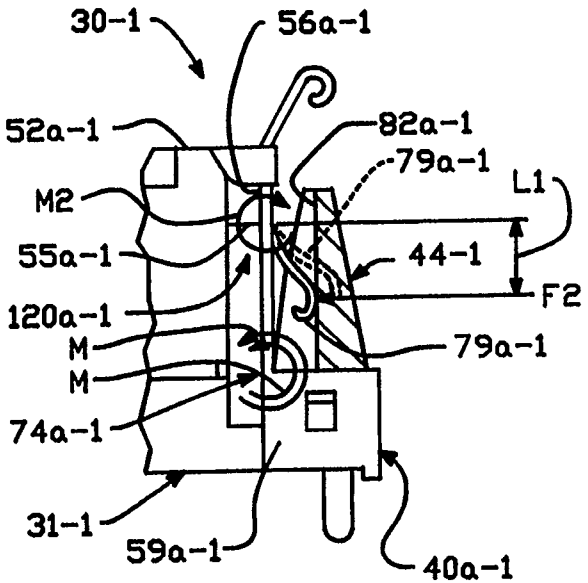
FIG. 4 is a vertical sectional view of the electrical connector assembly of FIG. 3 illustrating the stress reducing arm in the relaxed state.

The support post 42-1 defines an upstanding channel 81*a*-1 including a rear retaining wall 82*a*-1, as shown in FIGS. 3, 4 and 5A–5C. In FIG. 4, the stress reducing arm 79*a*-1 is illustrated in phantom lines to represent its relaxed state. When the respective latch 40-1 is mounted to the respective support post 42-1, the arm engages the retaining wall 82*a*-1 so that it is tensioned by a forces equal to F2. This respective force (F2) creates a secondary bending moment ($M2=F2 \times L1$, where L1 is the vertical distance between a first retaining force (F2) and the respective reducing arm juncture 120*a*-1 which is the intersection of the respective main body portion 56*a*-1 and the respective stress reducing arm 79*a*-1) about the respective reducing arm juncture 120*a*-1.

As is best viewed in FIG. 4, the secondary moment about the reducing arm juncture 120*a*-1 is in the direction opposite the primary bending moment (M3) created by the resiliency of the spring juncture 74*a*-1 itself. Collectively, when in the non-tensioned position illustrated in FIGS. 4 and 5(A), the effect of the primary bending moment (M3) is reduced by the oppositely directioned secondary bending moment (M2), forming the collective bending moment ($M4=M3-M2$). The collective moment (M4) about spring juncture 74*a*-1 still retainably urges the respective main body portion 56*a*-1 against the latch front stop 55*a*. However, the force which the main body portion 56*a*-1 abuts the respective latch front stop 55*a* is slightly smaller than if the respective stress reducing arm 79*a*-1 were not present.

More importantly, the stress concentration at the spring juncture 74*a*-1 is reduced and redistributed to the stress concentration created at the reducing arm juncture 120*a*-1 by the secondary bending moment M2). This reduces stress fracturing and metal fatigue at the spring juncture 120*a*-1.

Figure 5C:
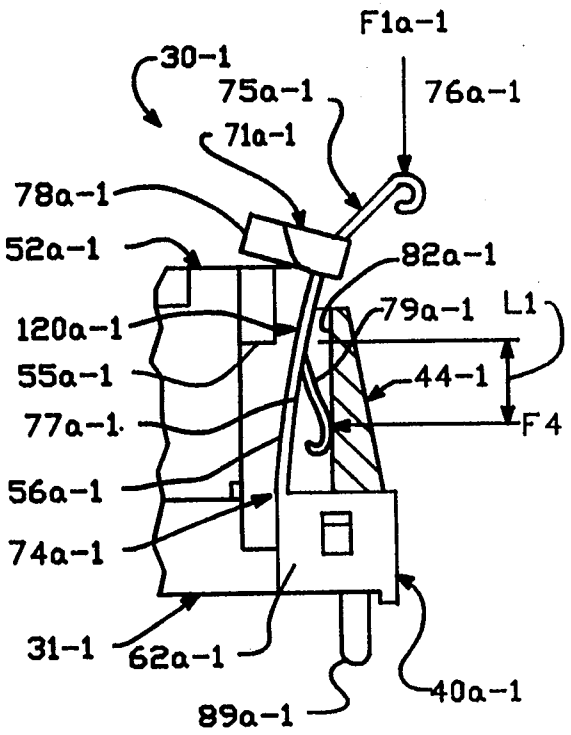
FIGS. 5A through 5C show a series of vertical sectional views of the electrical connector assembly of FIG. 3 at various stages of operation as the removable latch of the present invention is deflected rearward.
Figure 5B:
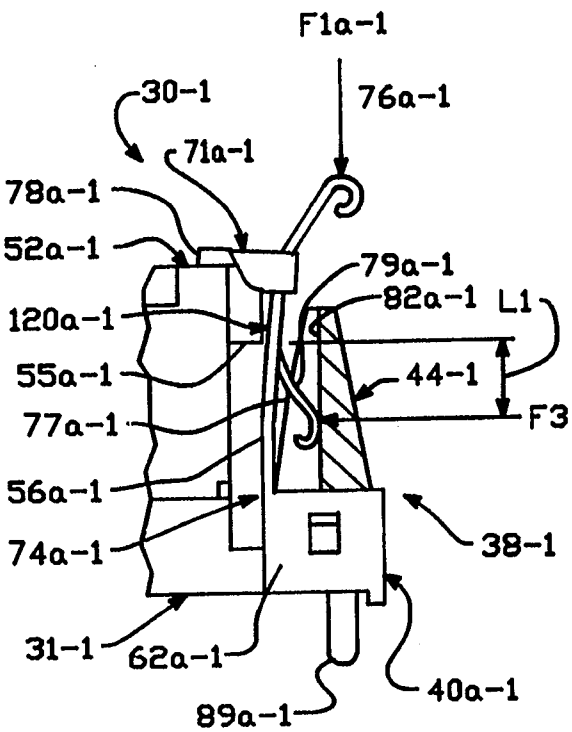
Figure 5A:
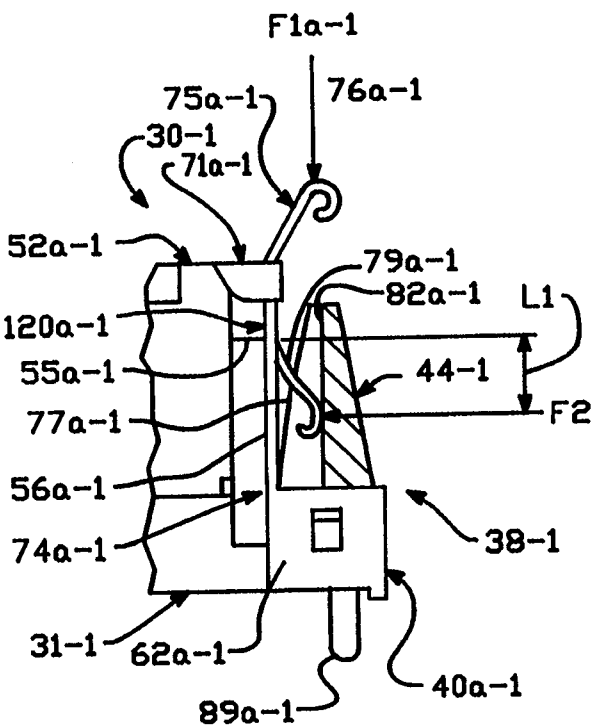

As may be seen in FIGS. 5(B) and 5(C), as the main body portion 56*a*-1 is deflected more rearward, the primary bending moment (not shown), as well as the stress concentration, about the spring juncture 74*a*-1 increases. However, this is offset by secondary bending moment (not shown) created about reducing arm juncture 120*a*-1 as the stress reducing arm 79*a*-1 increasingly engages, by a second and third retaining forces (F3) and (F4), respectively, against the rear retaining wall 82*a*-1 in the direction of the arrow. Accordingly, the stress concentrated at spring juncture 74*a*-1 is reduced proportionately.

In an alternative embodiment employing the stress reducing arm 79*a*-1 of the removable latch 40-1 of the present invention, two respective stress reducing arms (not shown) may be provided which extend downward from the respective top portion 57*a*-1 of the main body 56*a*-1. Although this specific embodiment is not show with respect to this particular mounting mechanism, the concept of dual stress reducing arms latch may best be illustrated in FIG. 22, which represents still another alternative latch embodiment 40-10 which will be discussed below. However, for the present purpose, it can be shown that the main body portion 56*a*-10 is centrally positioned while the respective reducing arms 79*a*-10 are positioned on opposing adjacent ends of the main body portion 56*a*-10. It will be appreciated that in this embodiment, the primary bending moment will now be created by the dual stress reducing arms 79*a*-10 while the secondary bending moment will be created by the main body portion 56*a*-10. Moreover, it will be appreciated that the retaining rear wall 82*a*-10 (not shown) will similarly oppose the respective dual stress reducing arms 79*a*-10, but will be positioned on the outer opposing edges of retaining portion 44-10 to allow engagement thereof.

Figure 6:
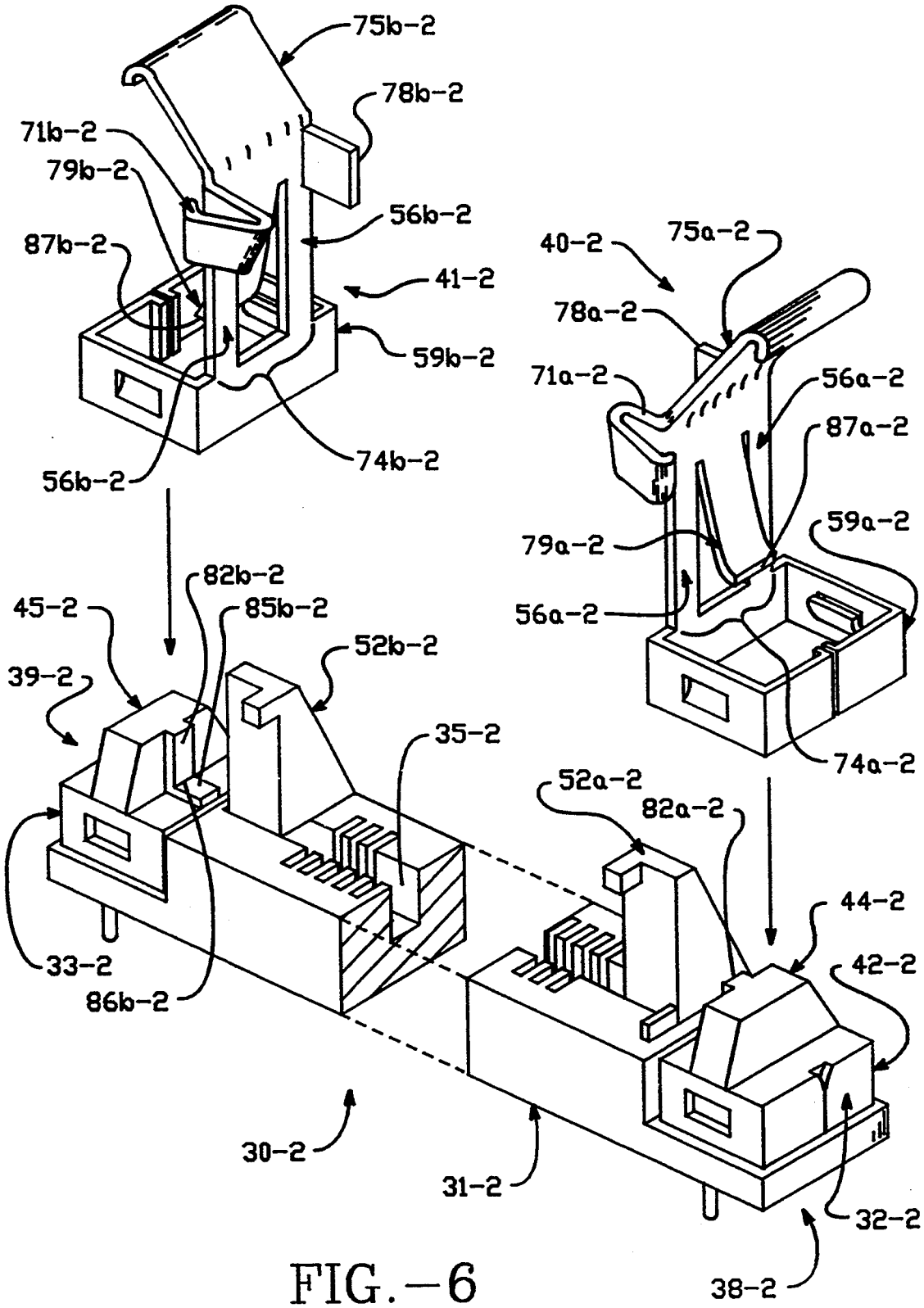
FIG. 6 is top perspective view of another embodiment of the electrical connector assembly of the present invention employing an alternative stress reducing arm.
Figure 7A:
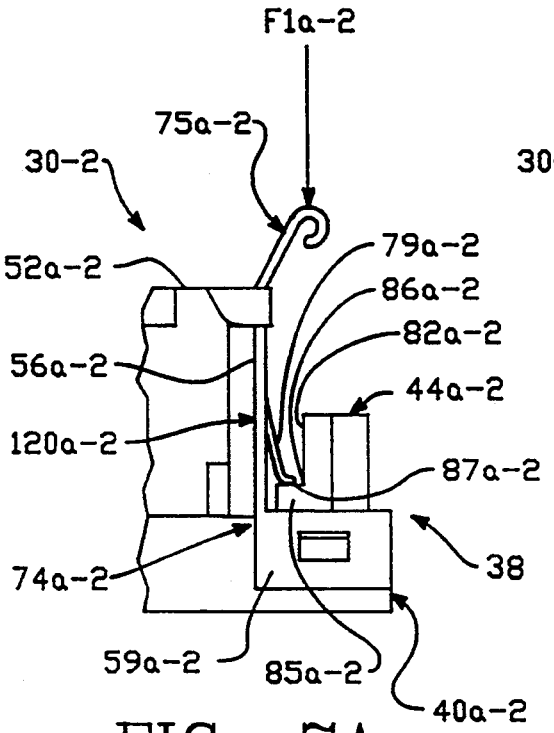
FIGS. 7A through 7C show a series of vertical sectional views of the electrical connector assembly of FIG. 6 at various stages of operation as the removable latch of the present invention is deflected rearward.
Figure 7B:
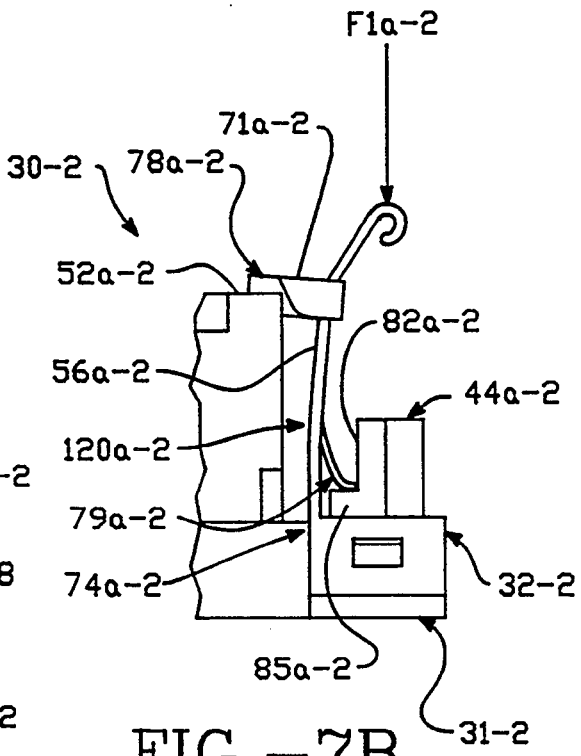
Figure 8:
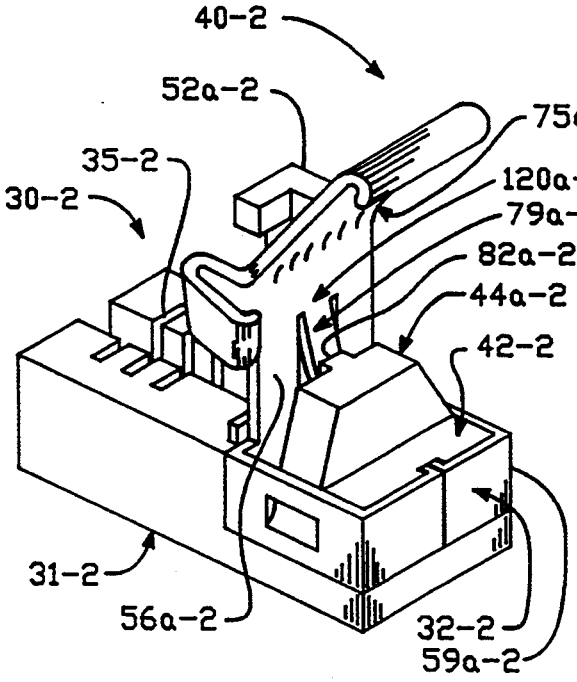
FIG. 8 is a fragmentary, top perspective view of the electrical connector assembly of FIG. 6 releasably mounting a removable latch of the present invention.
Figure 7C:
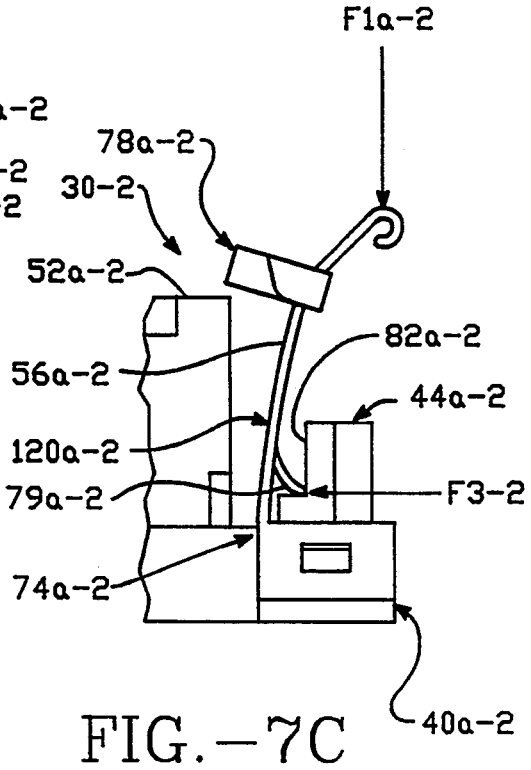

Referring now to FIGS. 6–8, another embodiment of the reduced stress arm 79*a*-2 is illustrated. In this embodiment, the arm 79*a*-2 contacts the retaining wall 82*a*-2 at a respective arm distal end 87*a*-2, as opposed to the mid-portion of the arm 79*a*-1, as occurs in the previous embodiment. As best viewed in FIGS. 7(A–C), the retaining wall 82*a*-1 protrudes outward toward the latch 40-2 from the retaining portion 44-2. A retaining step 85*a*-2 upstands from the base portion 42-2, and further, is adjacent to the protruding retaining wall 82*a*-2.

As shown in FIGS. 7(A) and 8, when the respective latch 40-2 is in a non-tensioned state, the distal end 87*a*-2 of the stress reducing arm 79*a*-2 abuts the retaining step 85*a*-2 which urges the main body portion 56*a*-2 forward up against the latch front stop 55*a*-2. However, as a downward force (F1*a*-2) is applied to the cantilever lever 75*a*-2, the arm distal end 87*a*-2 slides respectively rearward into a retaining juncture 86*a*-2 formed the intersection between the retaining wall 82*a*-2, and the retaining step 85*a*-2. Thus, engagement with the retaining juncture 86*a*-2 permits the stress reducing arm 79*a*-2 to create the oppositely directioned secondary bending moment (not shown) about at the reducing arm juncture 120*a*-2.

Figure 9:
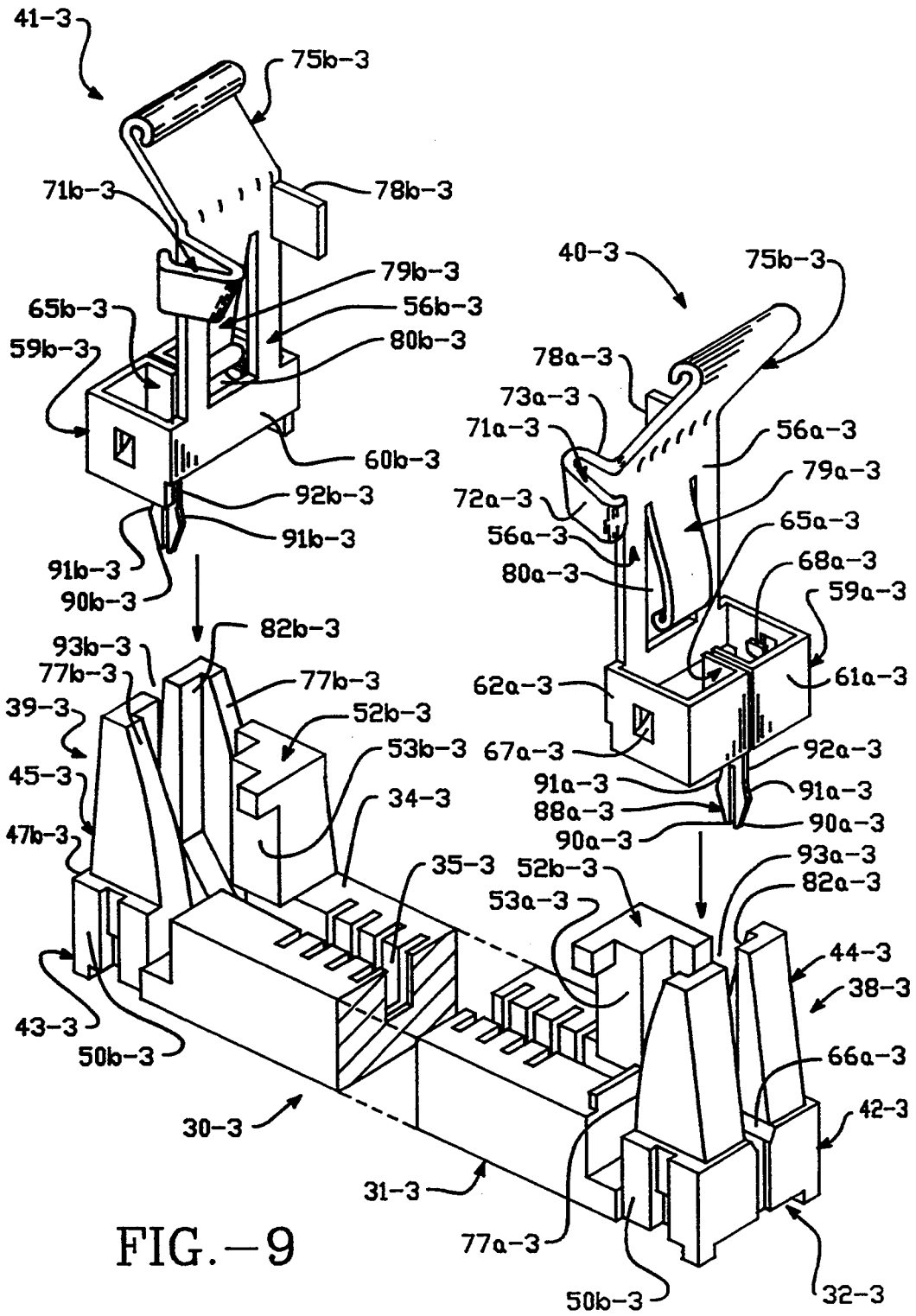
FIG. 9 is a fragmentary, top perspective view of another embodiment of the electrical connector assembly of the present invention which includes a primary circuit board mounting means.

FIG. 9 represents still another embodiment of the removable latches 40-3 and 41-3 of the present invention. In this alternative embodiment, however, the respective removable latches 40-3 and 41-3 which include the respective sleeve portion 59*a*-3 and 59*b*-3, also include a primary circuit board mounting means 88*a*-3 and 88*b*-3 extending vertically downward therefrom. Referring to first housing end 32-3, and corresponding latch 40-3, mounting means 88*a*-3 provide a means for releasably mounting the electrical connector 30-3 of the present invention to the primary circuit board (not shown). It will be appreciated that the mounting engaging means 88a-3 coupled to the latch 40-3 is appropriately positioned (discussed below) to replace the housing mounting post of the previous embodiments. Therefore, in this alternative latch embodiment 40-3, the electrical connector 30-3 may be more easily removed from the primary circuit board when desired. The respective sleeve portion 59a-3 is operative to securely engage the removable latch 40-3 to the connector housing 31-3, while the primary circuit board mounting means 88a-3 is operative to securely retain the first latch 40-3 and the entire housing 31-3 to the primary circuit board.

The board mounting means 88a-3 preferably comprises a downward extending, substantially planar engaging arm 92a-3 which includes a pair of aperture engaging fingers 90a-3. As can be seen in FIG. 9, the arm 92a-3 is coupled to the latch alignment edge 65a-3. To accommodate the arm 92a-3, the latch alignment edge 65a-3 protrudes further into the sleeve interior 64a-3 so that the respective mounting means 88a-3 may be affixed thereon.

Moreover, the support post 38-3 is modified to allow the mounting means 88a-3 to be positioned therethrough. A planar engaging means slot 93a-3 extends substantially through the support post 38-3 from the outermost rear wall 47a-3 in a direction inward toward the elongated board edge slot 35-3 and substantially parallel to the vertical slot plane. It will be appreciated that upon assembly of the latch 40-3 onto the support posts 38-3, the mounting means 88a-3 and the latch alignment edge 65a-3 will slidingly engage the engaging means slot 93a-3 to allow the base portion 42-3 to engage the sleeve portion 59a-3 of the latch 40-3. Thus, the aperture engaging fingers 90a-3 will protrude from the bottom of the housing 30-3 in a manner and position substantially similar to the housing mounting posts of the previous embodiments.

Each finger 90a-3 is inclined outward from its respective distal end such that an inward collapsing of the fingers 90a-3 is generated in response to forces exerted on the fingers as they are urged into an appropriately dimensioned mounting aperture (not shown) on the primary circuit board. Each respective finger 90a-3, further, includes locking surfaces 91a-3 for engaging a second surface of the primary circuit board opposite a first surface thereof on which the electrical connector 30-3 is positioned. Thus, as the respective fingers protrude through the mounting apertures located on the primary circuit board, the locking surfaces 91a-3 engage the second surface of the primary circuit board to releasably retain the electrical connector 30-3 to the primary circuit board.

The length of each respective mounting arm 92a-3 and 92b-3 is determined by the thickness of the primary circuit board. Thus, different board thicknesses can be accommodated by selecting the proper arm length.

Figure 10:
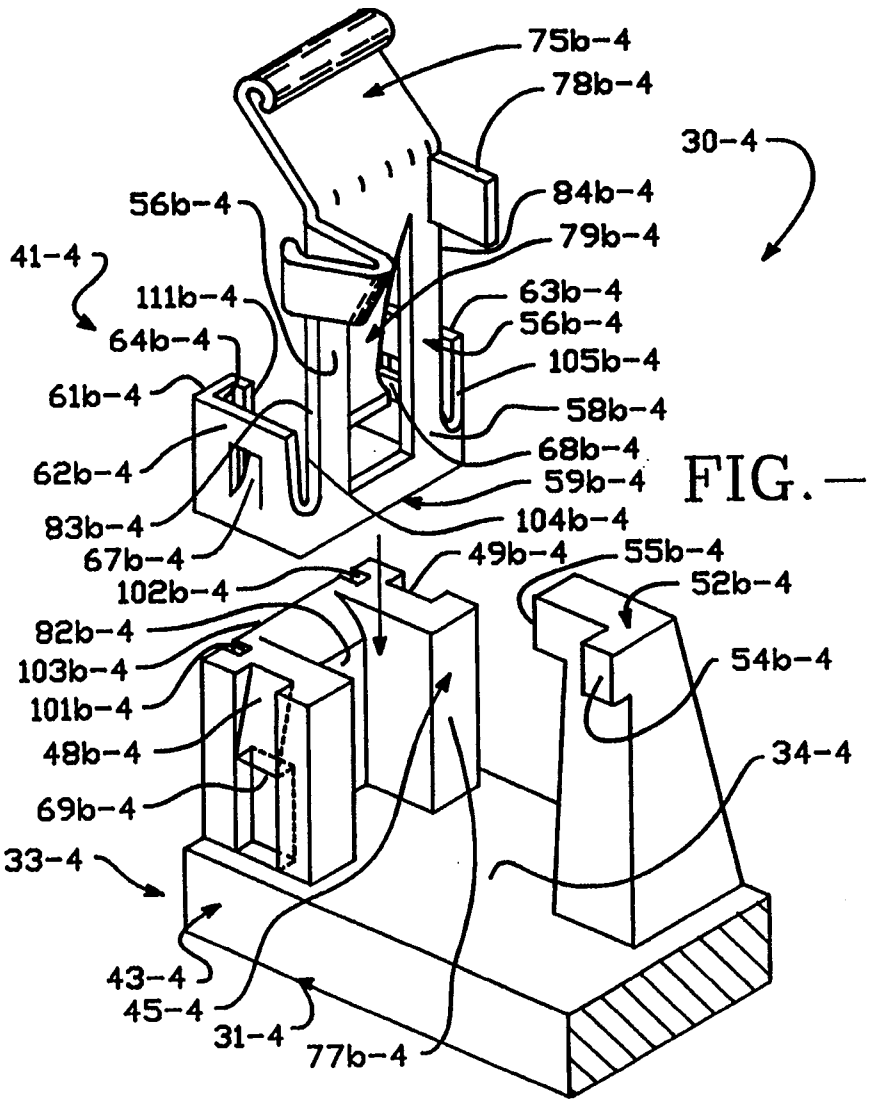
FIG. 10 is a fragmentary, top perspective view of an alternative embodiment of the present invention.

Another embodiment employing the sleeve portion mechanism of attachment to the housing end is illustrated in FIG. 10. In this embodiment, an alternative retainment mechanism is exhibited in which the respective sleeve portion 59b-4 of the latch 41-4 is removably mounted to, and aligned with, the housing 31-4 by the upper retaining portion 45-4, as compared to the base portion 43-4 of the previous embodiments. Therefore, the retaining portion 45-4 is dimensioned to insert into the respective sleeve portion 59b-4. Further, the respective first and second retainment slots 67b-4 and 68b-4, as well as the respective step portions 69b-4 and 70b-4 (not shown), are also defined by the upper retaining portion 45-4. Similarly, a first and a second vertical guidance slots 101b-4 and 102b-4 are defined by the upper retaining portion 45-4 disposed on a substantially vertical retaining portion rear wall 103b-4.

As shown in FIG. 10, the respective sleeve portion 59b-4 of the latch 41-4 remains coupled the bottom portion 58b-4 of the main body 56b-4. However, the sleeve portion 59b-4 extends upward from the bottom portion 58b-4, as opposed to extending downward, such that a first and a second sleeve gap 104b-4 and 105b-4 is formed between the edge of the respective first and second opposing sleeve side walls 62b-4 and 62b-4 and the respective first and second side edges 83b-4 and 84b-4 of the main body portion 56b-4. These respective sleeve gaps 104a-4 and 105b-4 permit the main body portion 56b-4 to move more freely into and out of the sleeve interior 64b-4. Moreover, a first and second substantially parallel latch alignment edge 111b-4 and 112b-4 (not shown) extend into the sleeve interior portion 64b-4 from the sleeve rear wall 61b-4.

The respective step portions 69b-4 and 70b-4 do not need to be positioned deeper into the backstop portion 45-4, as with the previous embodiments, in order to allow the respective barbs 67b-4 and 68b-4 to retainably engage therewith. As viewed in FIG. 10, the respective retaining slots 48b-4 and 49b-4 are inclined outward toward the respective sides of the backstop portion 45-4 to form the respective retaining step portions 69b-4 and 70b-4. Thus, the respective barbs 67b-4 and 68b-4 slide along the respective retaining slots 48b-4 and 49b-4 until they engage the respective step portions 69b-4 and 70b-4, thereby releasably retaining the latch 41-4 to the housing 31-4.

Accordingly, after assembly, when the respective sleeve portion 59b-4 snugly engages the retaining portion 45-4, the latch member 41-4 is removably secured to the housing 31-4 such that the retaining portion 4-43 provides adequate lateral support to retain the secondary circuit board in its operational position in electrical connector 30-4.

Figure 12:
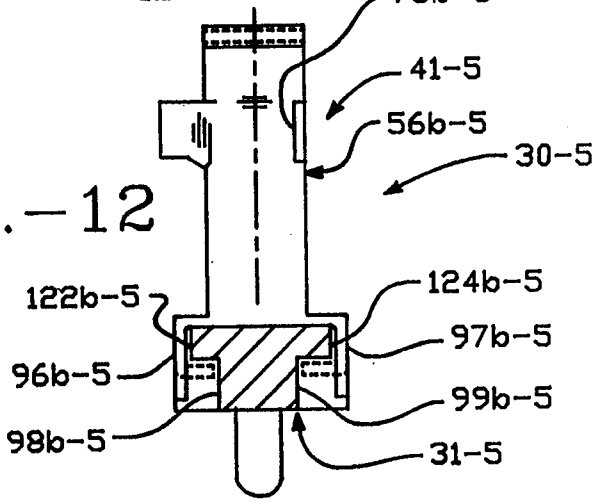
FIG. 12 is a vertical sectional view, taken substantially along the line 12—12 of FIG. 11, illustrating the staple mounting mechanism of the electrical connector assembly of FIG. 11
Figure 11:
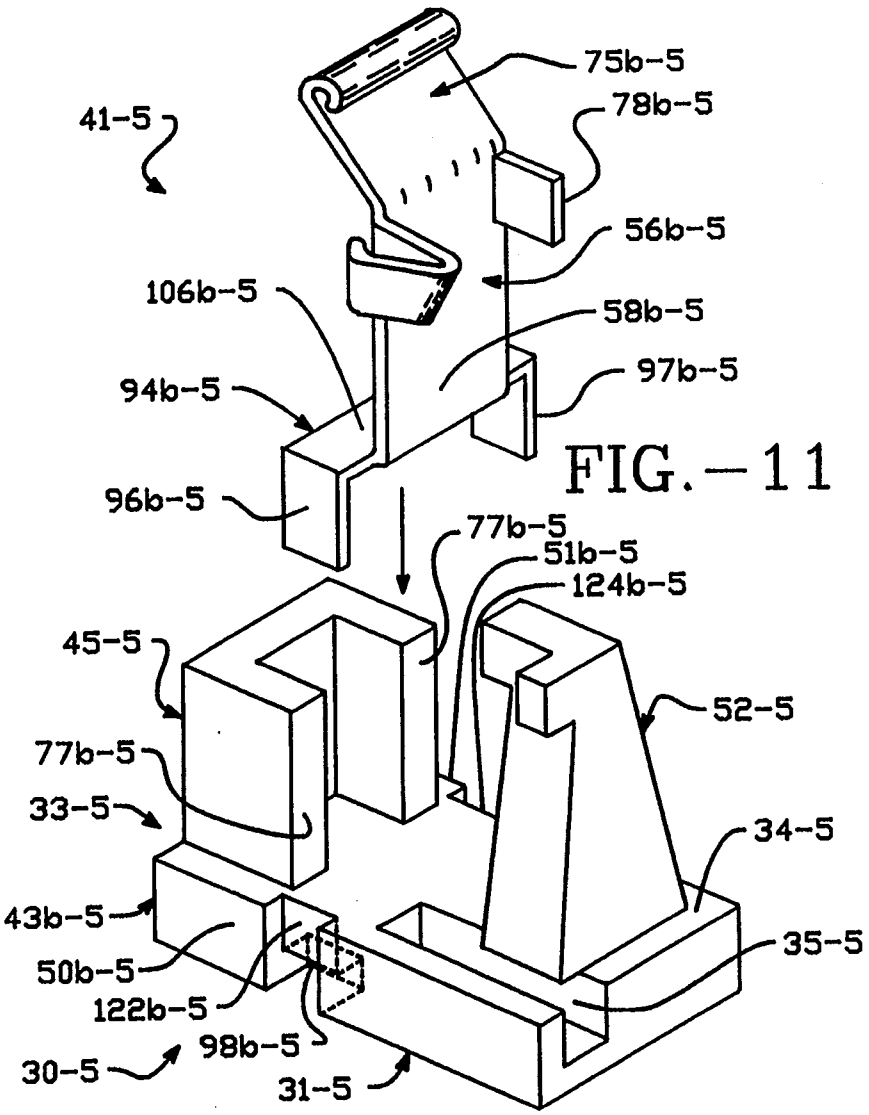
FIG. 11 is a fragmentary, top perspective view of an alternative embodiment of the present invention illustrating the staple mounting mechanism for attachment to the connector housing.

The next electrical connector represents the preferred mechanism of attachment to the insulative housing 31-5, as shown in FIG. 11. In this embodiment, the main body bottom portion 58b-5 of the latch 41-5 is coupled to a mounting platform 94b-5 which replaces the sleeve portions of the previous embodiments. As may be seen in FIGS. 11–13, the mounting platform 94b-4 is comprised of a substantially rectangular upper support plate 106b-4 which extends perpendicularly rearward from the main body bottom portion 58b-5 in the direction substantially parallel to the housing top side 34-5 in which it will supportably mate. Respective first and second mounting fingers 96b-5 and 97b-5 extend perpendicularly downward from the opposing side ends of the rectangular support plate 106b-5 in a direction substantially parallel to the respective first and second opposing base side walls 50b-5 and 51b-5 of the base portion 43-5. It will be appreciated that the first and second downwardly bent mounting fingers 96b-5 and 97b-5 are laterally spaced apart by a distance substantially equal to the cross-sectional width of the housing connector top side 34-5. The properly spaced apart first and second mounting fingers 96b-5 and 97b-5 assure that the mounting platform 94b-4 is snugly supported by the base portion 43-5 of the respective second support post 39-5, as illustrated in FIG. 12.

The base portion 43-5 of the respective support post 39-5 defines respective first and second alignment finger grooves **122*b*-5 and 124*b*-5 disposed on the respective first and second opposing base side walls 50*b*-5 and 51*b*-55. These respective alignment finger grooves 122*b*-5 and 124*b*-5 are dimensioned to flushly receive the respective first and second mounting fingers 96*b*-5 and 97*b*-5 such that the respective fingers are seated an aligned. Thus, this helps align the respective latch 41 upon mounting to the housing 31-5** (discussed henceforth) and, further, provide lateral support when the secondary circuit board is mounted.

Figure 13:
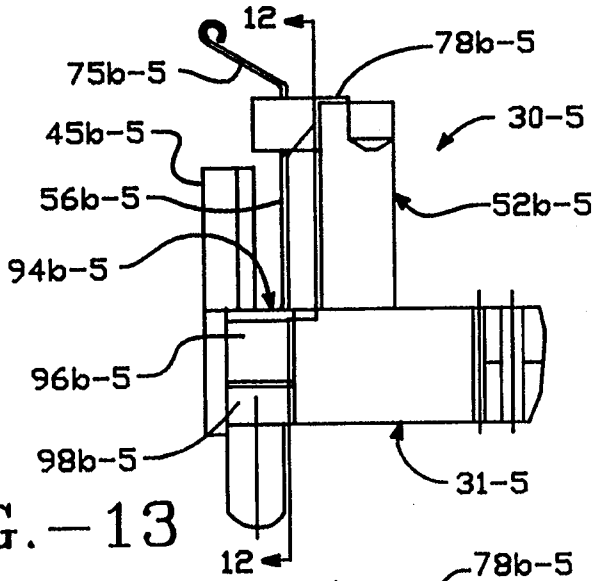
FIG. 13 is a fragmentary, side elevation view of the electrical connector assembly of FIG. 11.

Further, the first and second mounting finger slots **98*b*-5 and 99*b*-5 (not shown) are also disposed on the respective first and second opposing base side walls 50*b*-5 and 51*b*-55. These respective finger slots 98*b*-5 and 99*b*-5 are dimensioned to accept the respective first and second mounting fingers 96*b*-5 and 97*b*-5, as shown in FIGS. 12 and 13. Reminiscent of a staple, hence its name, the respective distal ends of the mounting fingers 96*b*-5 and 97*b*-5 are bent inward towards the respective first and second mounting finger slots 98*b*-5 and 99*b*-5, shown in the phantom lines in FIG. 12. This staple mounting mechanism simplifies installation and enhances lateral support to the latch 41-5 when the respective distal ends of the mounting fingers 96*b*-5 and 97*b*-5 engage the respective finger slots 98*b*-5 and 99*b*-5. Accordingly, the respective latch 41-5 is securely mounted to the second housing end 33-5**.

The respective upstanding backstop portion 45-5 provides a rear latch backstop wall **77*b*-5** much like the previous embodiments.

Figures 14, 15, 18, 19, 20:
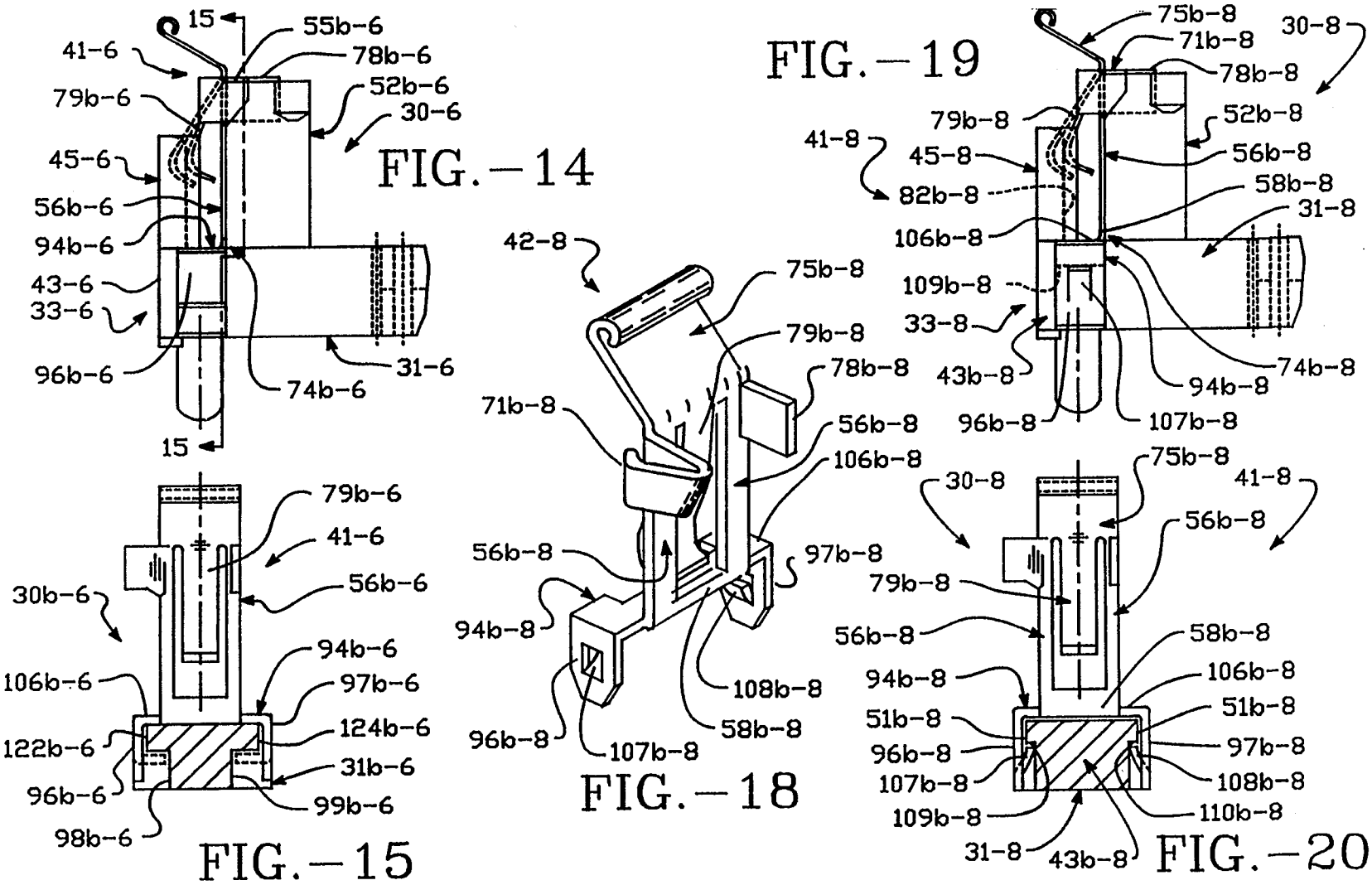
FIG. 14 is a fragmentary, side elevation view of the electrical connector assembly of FIG. 11 including a stress reducing arm.
FIG. 15 is a vertical sectional view, taken substantially along the line 15—15 of FIG. 14, illustrating the staple mounting mechanism of the electrical connector assembly of FIG. 14.
FIG. 18 is a top perspective view of an alternative latch embodiment illustrating the barbs of the mounting mechanism.
FIG. 19 is a fragmentary, side elevation view of the electrical connector assembly of FIG. 18.
FIG. 20 is a vertical sectional view, taken substantially along the line 19—19 of FIG. 19, of the electrical connector assembly of FIG. 19.

FIGS. 14 and 15 represent the preferred previous staple mounting mechanism embodiment which includes a stress reducing arm **79*b*-6. As with the previous embodiments, the stress reducing arm 79*b*-6, when engaged with the retaining wall 82*b*-6 of the upstanding retaining portion 45-6, decreases the stress concentration at the spring juncture 74*b*-6. This embodiment includes a latch front stop 55*b*-6 protruding toward the respective latch 41-6 from the rear circuit board support 52*b*-6** to prevent over-extension.

Figure 17:
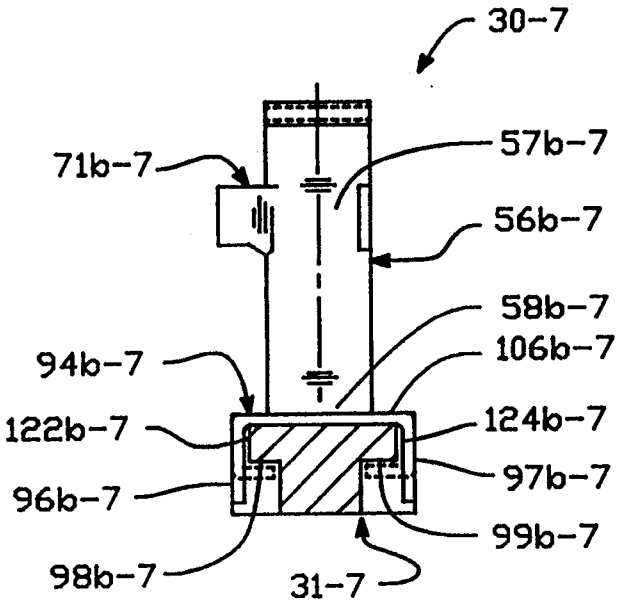
FIG. 17 is a vertical sectional view of the staple mounting mechanism of the electrical connector assembly of FIG. 16 illustrating the latch mounted to the housing.
Figure 16:
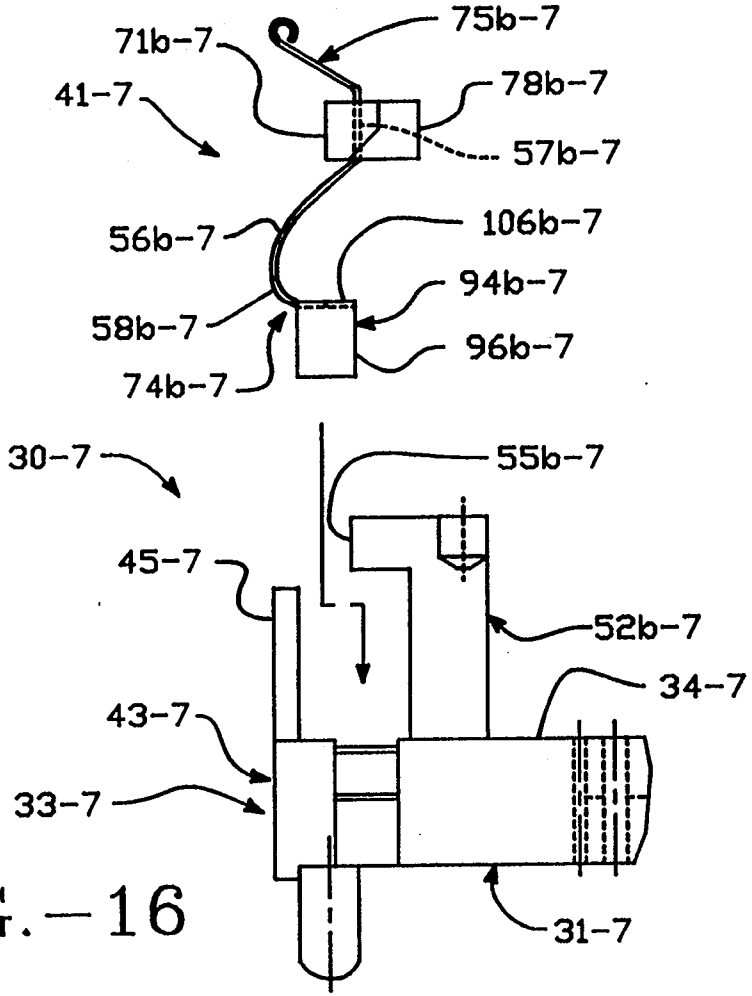
FIG. 16 is a fragmentary, side elevation view of another embodiment of the present invention employing the staple mounting mechanism.

Referring to FIGS. 16 and 17 an alternative main body portion **56*b*-7 is illustrated coupled to the mounting platform 94*b*-7. Unlike the previous embodiments, the main body portion 56*b*-7 of this embodiment is substantially curved, rather than planar. Thus, although the vertical height between the latch lug 71*b*-7 and the housing top side 34-7 remains substantially similar, the actual length of the mainbody portion 56*b*-7 is longer than the previous embodiments because of its curved positioning. This increased length enhances the overall flexibility of the main body portion 56*b*-7 which reduces stress concentration at spring juncture 74*b*-7. As will be described in greater detail below, this curvature and increased flexibility distributes the bending stress throughout the main body portion 56*b*-7** when the same is deflected rearward during installation or removal of the secondary circuit board.

As illustrated in FIG. 16, the mounting platform **94*b*-7 is mounted forward of the main body bottom side 58*b*-7, as opposed to being mounted rearward. Moreover, the bottom portion 58*b*-7 of the main body portion 56*b*-7 extends from the rectangular mounting support plate 106*b*-7 in a direction substantially parallel to the plate. In the previous latch embodiments, the mainbody portion extends substantially perpendicular therefrom. Thus, as the main body portion 56*b*-7 is displaced reward, the stress acting on the main body portion 56*b*-7 is absorbed all along the curvature. Accordingly, the bending stress is not narrowly concentrated at the spring juncture 74*b*-7 because it is distributed throughout the curvature of the main body portion 56*b*-7. This produces a result similar to the stress reducing arms, i.e., reducing stress at the spring juncture 74*b*-7, but in a different manner. Therefore, while according many of the benefits of a stress reducing arm, the curved main body portion 56*b*-7 of this latch embodiment 41-7** structurally simpler than embodiments employing the stress reducing arms.

The upper portion **57*b*-7 of the main body portion 56*ab*-7, however, remains substantially planar to promote planar engagement with the front latch stop 55*b*-7. Further, the backstop portion 45-7** which prevents latch over-extension is simplified and substantially planar.

Another alternative mounting mechanism mounting the removable latches 40-8 (not shown) and 41-8 to the housing 31-8 is illustrated in the connector assembly 30-8 of FIGS. 18–20. Similar to the staple mounting mechanism of the previous embodiment, this mounting mechanism comprises a mounting platform **94*b*-8 which includes a rectangular support plate 106*b*-8 extending perpendicularly rearward from the main body bottom portion 58*b*-8. Again, respective first and second mounting fingers 96*b*-8 and 97*b*-8 extend perpendicularly downward from the opposing side ends of the rectangular support plate 106*b*-8**.

However, in this mounting embodiment, the respective distal ends of the first and second mounting fingers **96*b*-8 and 97*b*-8 are not bent inward, respectively, toward one another. Rather, retainment is provided by first and second inwardly inclined barbs 107*b*-8 and 108*b*-8 which are defined by the respective first and second mounting fingers 96*b*-8 and 97*b*-8. These respective barbs 107*b*-8 and 108*b*-8 represent an uncomplicated mechanism for mounting the respective latch 41-8 to the respective second housing end 33-8**.

As best illustrated in FIG. 19, the respective base portion 43-8 defines a respective first and second barb step **109*b*-8 and 110*b*-8 positioned oppositely on the respective first and second opposing base side walls 50*b*-8 and 51*b*-8. The first and second barb steps 109*b*-8 and 110*b*-8 are appropriately aligned and dimensioned to engage the corresponding first and second mounting finger barbs 107*b*-8 and 108*b*-8. Thus, after engagement with the respective steps 109*b*-8 and 110*b*-8, the respective latch 41-8 will be securely mounted to the respective housing end 33-8**.

Figure 21:
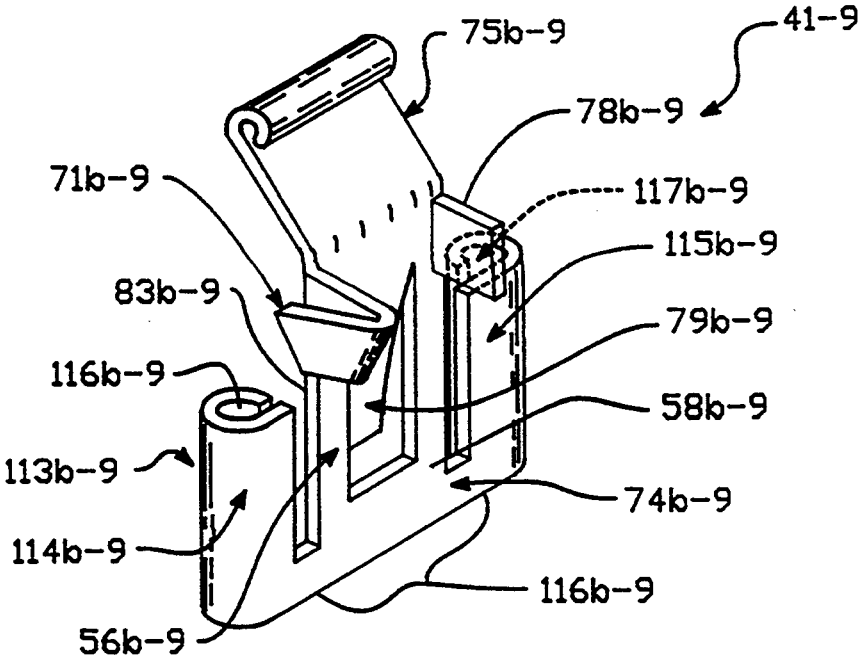
FIG. 21 is an enlarged top perspective view of an alternative latch embodiment illustrating the post receiving sleeves.

FIG. 21 represents yet another removable latch alternative embodiment mounting mechanism of the present invention. Coupled to the main body bottom portion **58*b*-9 of the removable latch 41-9 is a dual post receiving mounting mechanism 113*b*-9 which comprises respective first and second upstanding cylindrical sleeves 114*b*-9 and 115*b*-9 disposed adjacent the opposing first and second main body edges 83*b*-9 and 84*b*-9, respectively. As shown, the first and second cylindrical sleeves 114*b*-9 and 115*b*-9 are coupled together at the opposing longitudinal edges of a substantially vertical connecting plate 116*b*-9 positioned therebetween. Moreover, a top edge of the vertical connecting plate 116*b*-9 is coupled to the main body bottom portion 58*b*-9 which defines the respective spring juncture 74*b*-9**.

The respective first and second cylindrical sleeves **114*b*-9 and 115*b*-9 are dimensioned to receive corresponding, respective first and second support posts (not shown) upstanding from the housing top side (not shown) of the respective second housing end (not shown). These respective first and second support posts are preferably inclined outward from the respective distal ends such that the respective first and second cylindrical sleeves 114b-9 and 115b-9 may be snugly mounted thereon. Positioned in the respective interior portions 116b-9 and 117b-9 of the respective first and second cylindrical sleeves 114b-9 and 115b-9 are retaining barbs (not shown) which releasably retain the latch 41-9 onto the respective support posts thereon. Moreover, these respective support posts provide lateral stability to the respective latches 40-9 (not shown) and 41-9** so that the secondary circuit board may be securely mounted in its operating position.

Figure 22:
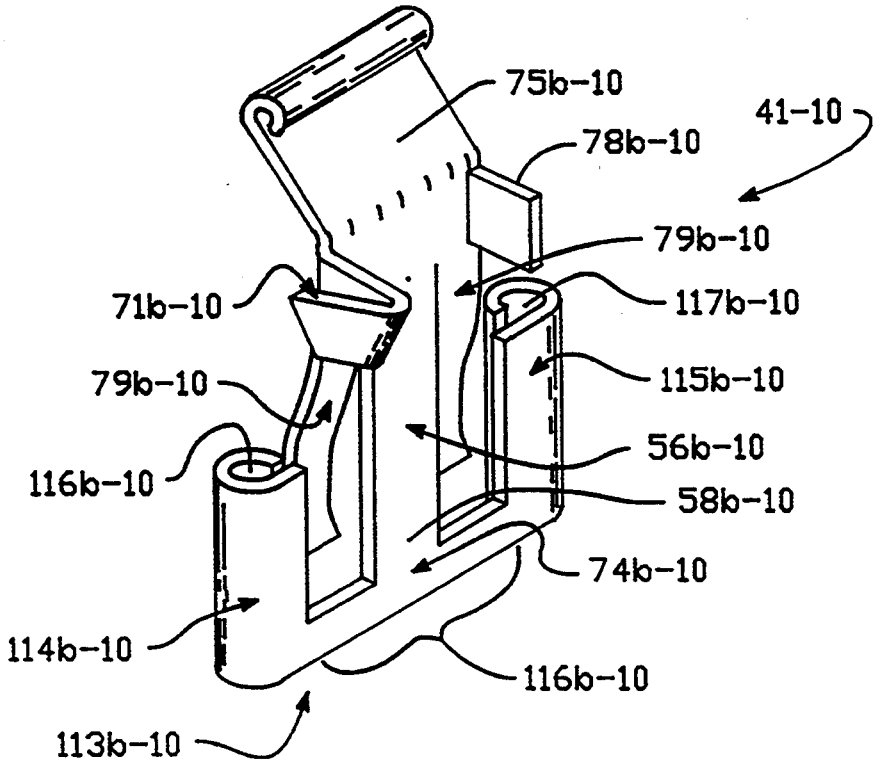
FIG. 22 is an enlarged top perspective view of the latch embodiment of FIG. 21 employing dual stress reducing arms.

Referring now to FIG. 22, as previously mentioned, this alternative latch 40-10 illustrates the dual post receiving mounting mechanism 113b-10 coupled to the main body portion 56b-10 including dual stress reducing arms 79b-10. Both of these components have been previously discussed in detail, and, thus, will not be repeated here.

Figures 23, 24:
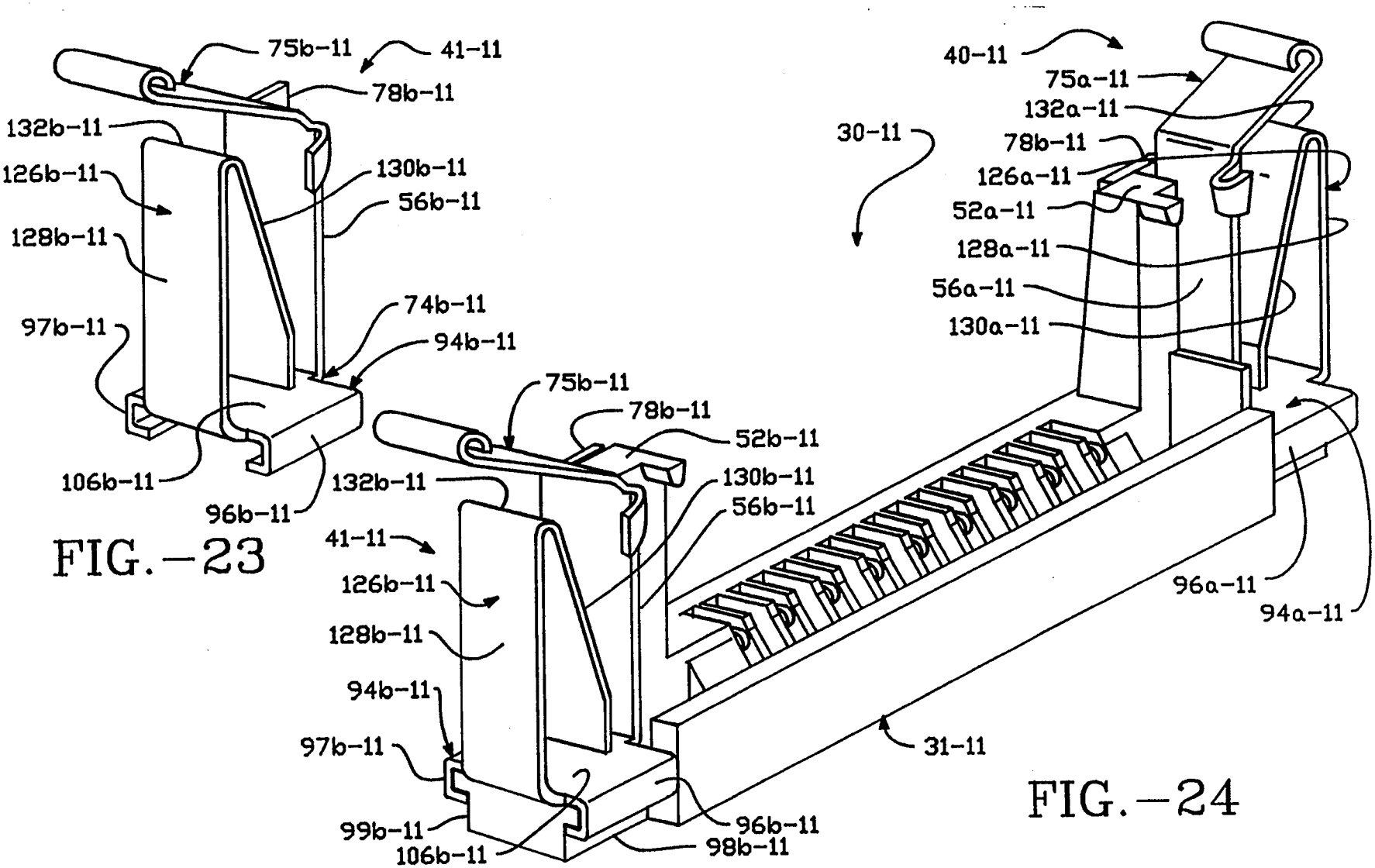
FIG. 23 is a top perspective view of another latch embodiment of the present invention employing the staple mounting mechanism which includes a resilient backstop support.
FIG. 24 is a top perspective view of a connector assembly employing the latches of FIG. 23.

Another alternative embodiment employing the staple mounting mechanism is illustrated in FIG. 23. As may be seen, the latch 41-11 includes a resilient backstop portion 126b-11 integrally coupled to the mounting platform 94b-11. Extending upward from the rear end of rectangular support plate 106b-11 is an upstanding resilient backstop support 128b-11. This support 128b-11 is substantially perpendicular to rectangular support plate 106b-11 and is mounted to the end opposite, but substantially parallel to, the main body portion 56b-11. Coupled to the upper distal end of resilient backstop support 128b-11 is a resilient backstop plate 130b-11 inclined downward toward the spring juncture 74b-11. The resilient backstop spring juncture 132b-11 between the upper distal end of resilient backstop support 128b-11 and the upper distal end of the resilient backstop plate 130b-11 form a resilient spring.

Therefore, the main body portion 56b-11 may be displaced reward until it engages the resilient backstop portion 128b-11. Upon engagement, the main body portion 56b-11 substantially contacts the resilient backstop plate 130b-11 which tensions the resilient backstop spring juncture 132b-11. This acts to urge the main body portion 56b-11 forward toward the respective board support post 52b-11, as shown in FIG. 24. Accordingly, not only does the resilient backstop portion 128b-11 provide a backstop to prevent over-extension of the main body portion 56b-11, it also provides a backstop spring juncture 132b-11 which, together with the spring juncture 74b-11, urge main body portion 56b-11 forward.

FIG.24 illustrates the connector assembly 30-11 with the first and second latches 40-11 and 41-11 mounted to the housing 31-11. In the preferred form, the respective first and second mounting fingers 96b-11 and 97b-11 are wider than the previous staple-mounting embodiments in order to provide better lateral support.

Figures 25, 26:
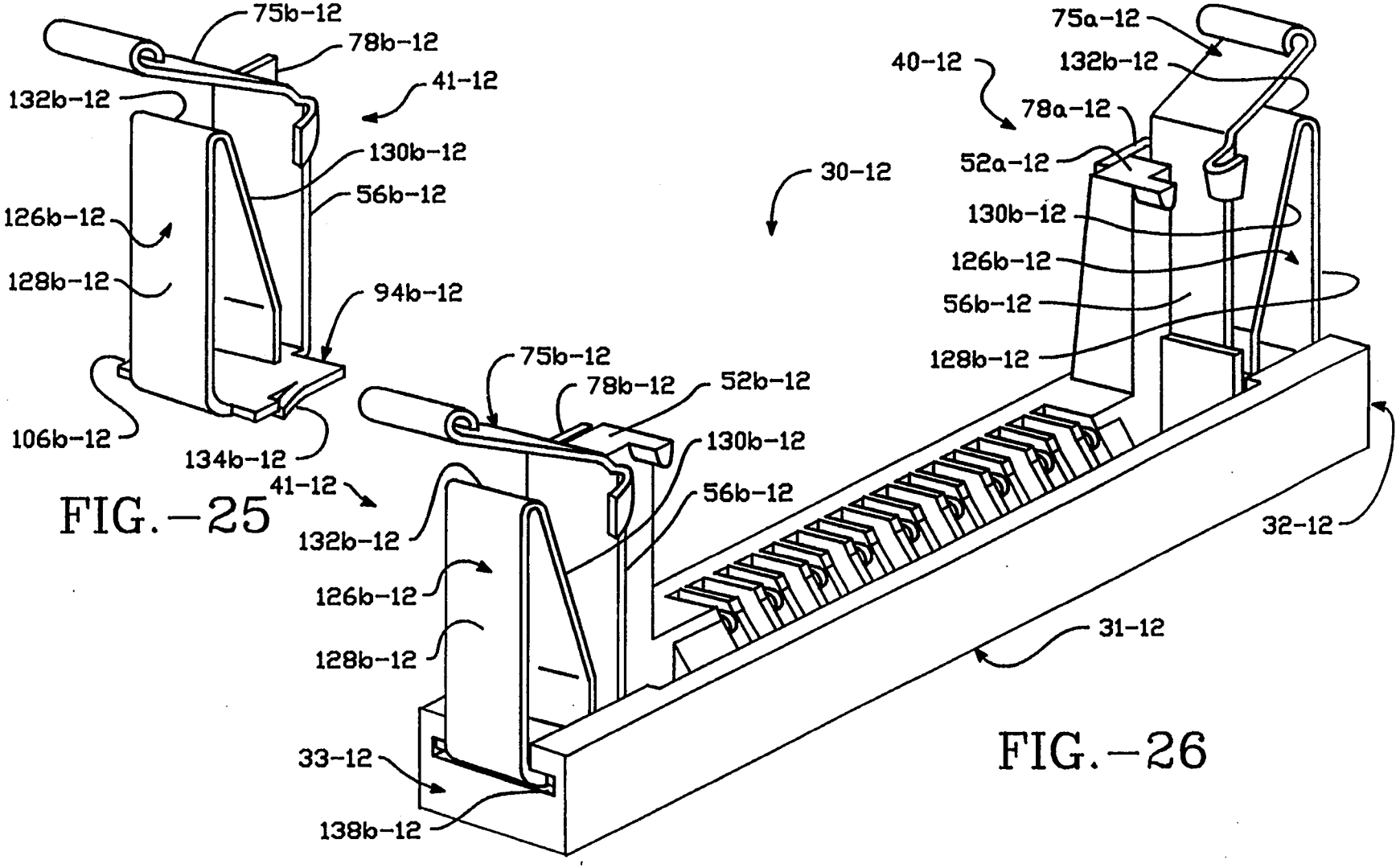
FIG. 25 is a top perspective view of another latch embodiment of the present invention including the resilient backstop support and employing an alternative mounting mechanism.
FIG. 26 is a top perspective view of a connector assembly employing the latches of FIG. 23.

Referring now to FIG. 25, an alternative mounting platform 94b-12 is coupled to the latch 41-12 including the resilient backstop portion 126b-12. As shown, the mounting platform 94b-12 does not include mounting fingers coupled to the ends of the rectangular support plate 106b-12. Rather, a first and a second support plate barb 134b-12 and 136b-12 (not shown), respectively, are provided to retainably mount the latch 41-12 to the connector housing 31-12. As shown in FIG. 26, the respective second housing end 33-12 defines a rectangular support plate mounting slot 138b-12 in which the respective rectangular support plate 106b-12 slidably engages. Respective first and second support plate barbs 134b-12 and 136b-12 engage the inner walls of the mounting slot 138b-12 to securely retain the latch 41-12 to the housing 31-12.

While the invention has been described in connection with what is presently considered to be the most practical and preferred embodiments, it is to be understood that the invention is not limited to the disclosed embodiment but, on the contrary, is intended to cover various modifications and equivalent arrangements included within the spirit and scope of the appended claims.

Therefore, persons of ordinary skill in this field are to understand that all such equivalent structures are to be included within the scope of the following claims:

What is claimed is:

1. A circuit board latching device for use with an insulative connector housing which includes a retaining wall and a circuit board support post, the board support post positioned opposite the retaining wall, said latching device comprising:

a main body portion;

a mounting member for mounting said main body portion to the housing between the retaining wall and the board support post;

a latch lug extending from said main body portion, said latch lug including a cam surface inclined relative to said main body portion and a lock surface substantially perpendicular to said main body portion; and a stress reducing member remote and independent from said mounting member, and including a resilient arm projecting angularly away from said main body portion toward and engaging the retaining wall.

2. The device as defined in claim 1 wherein, said resilient arm projects downwardly from proximate an upper portion of said main body portion to urge said upper portion toward the support post upon contact with the retaining wall.

3. The device as defined in claim 1 wherein, said arm more forcibly contacts the retaining wall when said main body portion is deflected away from the board support post.

4. The device as defined in claim 1 wherein, the distal end of said resilient arm is curved toward said main body portion.

5. The device as defined in claim 1 wherein, said stress reducing arm urges said main body portion against said board support post.

6. The device as defined in claim 1 wherein, said mounting members comprises an upstanding sleeve mounting member extending from said main body portion.

7. The device as defined in claim 1 wherein, said mounting members comprises at least two upstanding sleeve mounting members adjacently respectively coupled to said main body portion.

8. The device as defined in claim 1 wherein, said mounting numbers comprises a mounting platform including a plate extending from said main body portion, a first finger extending substantially downward from one end of said plate, and a second finger extending substantially downward from the opposite end of said plate, each respective first and second finger includes finger mounting means.

9. The device as defined in claim 1 further including:

a latch lever coupled to a top portion of said main body and projecting angularly outward from said main body to form a cantilever projection therefrom.

10. A metal latch for an electrical connector, the connector comprising an insulative housing including a front side wall defining a front side cavity, an oppositely disposed rear side wall defining a rear side cavity, said latch comprising:

a mounting plate including a first side and an oppositely disposed second side;

a flexible main body portion resiliently secured to the first side of said plate and extending upward therefrom;

a support secured to the second side of said plate and extending upward therefrom; and a backstop secured to said support and extending therefrom toward said main body portion such that said main body portion can abut against the backstop when said main body portion is resiliently displaced toward said support.

11. The latch device as defined in claim 10 further including:

a latch lever projecting angularly outward from a top portion of said main body portion to form a cantilever projection therefrom.

12. The latch device as defined in claim 10 further including:

a latch lug extending from said main body portion, said latch lug including a cam surface inclined relative to said main body portion and a lock surface substantially perpendicular to said main body portion.

13. The latch device as defined in claim 10 further including:

a latch lever projecting angularly outward from a top portion of said main body portion to form a cantilever projection therefrom; and a latch lug extending from said main body portion, said latch lug including a cam surface inclined relative to said main body portion and a lock surface substantially perpendicular to said main body portion.

14. The latch device as defined in claim 10 further including:

a guidance latch plate extending from said main body away from said support.

15. The latch device as defined in claim 10 further including:

a latch lever projecting angularly outward from a top portion of said main body portion to form a cantilever projection therefrom;

a latch lug extending from said main body portion, said latch lug including a cam surface inclined relative to said main body portion and a lock surface substantially perpendicular to said main body portion; and a guidance latch plate extending from said main body away from said support.

16. The latch device as defined in claim 10 wherein, said backstop is inclined relative to the plate.

17. The latch device as defined in claim 10 wherein, said backstop is inclined angularly downward relative to the plate.

18. The latch device as defined in claim 10 wherein, said backstop can abut the plate when said main body abuts the backstop.

19. The metal latch as defined in claim 10 wherein, said mounting plate includes mounting means for securely engaging the front side cavity and the second rear side cavity.

20. The latch device as defined in claim 19 wherein, said mounting means includes a first finger extending downward from a third side of the plate, and a second finger extending downward from an oppositely disposed fourth side of the plate.

21. The latch device as defined in claim 20 wherein, said first finger includes a first distal end formed to be skewed into the front side cavity, and said second finger includes a second distal end formed to be skewed into the rear side cavity.

22. The latch device as defined in claim 21 wherein, said first finger includes a first mounting barb dimensioned to securely engage the front side cavity, and said second finger includes a second mounting barb dimensioned to securely engage the rear side cavity.

23. The latch device as defined in claim 10 further including:

mounting means coupled to said mounting plate for securely engaging the front side cavity and the second rear side cavity;

a latch lever projecting angularly outward from a top portion of said main body portion to form a cantilever protection therefrom; and a latch lug extending from said main body portion, said latch lug including a cam surface inclined relative to said main body portion and a lock surface substantially perpendicular to said main body portion.

24. The latch device as defined in claim 23 wherein, said mounting means includes a first finger extending downward from a third side of the plate, and a second finger extending downward from an oppositely disposed fourth side of the plate.

25. The latch device as defined in claim 24 wherein, said first finger includes a first deformable distal end formed to be bent into the front side cavity, and said second finger includes a second deformable distal end formed to be bent into the rear side cavity.

26. The latch device as defined in claim 24 wherein, said first finger includes a first mounting barb dimensioned to securely engage the front side cavity, and said second finger includes a second mounting barb dimensioned to securely engage the rear side cavity.

27. The latch device as defined in claim 24 further including:

a guidance latch plate extending from said main body away from said support.

28. A metal latch for an electrical connector, the connector comprising an insulative housing including a top side defining an elongated slot, a first side wall defining a first side cavity, an oppositely disposed second side wall defining a second side cavity, said latch comprising:

a generally planar mounting plate formed for substantial abutting support against the housing topside, and including a front side facing the elongated slot and an oppositely disposed rear side, and a first side and an oppositely disposed second side;

a flexible main body portion including a substantially vertical top portion and a bottom portion resiliently secured to and angled away from the front side of the plate;

a first finger secured to the first side of the plate and extending downward therefrom, said first finger including a first mounting means for securely engaging the first side cavity of the housing; and a second finger secured to the second side of the plate and extending downward therefrom, said second finger including a second mounting means for securely engaging the second side cavity of the housing.

29. The latch device as defined in claim 28 wherein, said first mounting means comprises a first deformable end formed to be bent into said first side cavity, and said second mounting means comprises a second deformable end formed to be bent into said second side cavity.

30. The latch device as defined in claim 28 wherein, said first mounting means comprises a first mounting barb dimensioned to securely engage said first side cavity, and said second mounting means comprises a second mounting barb dimensioned to securely engage said second side cavity.

31. The latch device as defined in claim 28 further including:

a latch lever projecting angularly outward from a top portion of said main body portion to form a cantilever projection therefrom.

32. The latch device as defined in claim 28 further including:

a latch lug extending from the top portion of said main body portion, said latch lug including a cam surface inclined relative to said top portion and a lock surface substantially perpendicular to said top portion.

33. The latch device as defined in claim 28 further including:

a latch lever projecting angularly outward from the top portion of said main body portion to form a cantilever projection therefrom; and a latch lug extending from the top portion of said main body portion, said latch lug including a cam surface inclined relative to said top portion and a lock surface substantially perpendicular to said top portion.

34. The latch device as defined in claim 28 further including:

a latch lever projecting angularly outward from the top portion of said main body portion to form a cantilever projection therefrom; and a latch lug extending from the top portion of said main body portion, said latch lug including a cam surface inclined relative to said top portion and a lock surface substantially perpendicular to said top portion;

wherein said first mounting means comprises a first deformable end formed to be skewed into said first side cavity; and wherein said second mounting means comprises a second deformable end formed to be skewed into said second side cavity.

35. The latch device as defined in claim 28 further including:

a guidance latch plate extending from the top port; on of said main body toward the elongated slot.

36. A circuit board latching device for use with an insulative connector housing which includes a retaining wall and a circuit board support post, the board support post positioned opposite the retaining wall, said latching device comprising:

a main body portion;

a mounting member having at least two upstanding sleeve mounting portions each adjacently coupled to said main body portion for mounting said main body portion to the housing between the retaining wall and the board support post;

a latch lug extending from said main body portion, said latch lug including a cam surface inclined relative to said main body portion and a lock surface substantially perpendicular to said main body portion; and a stress reducing member including a resilient arm projecting angularly away from said main body portion toward the retaining wall.

37. A circuit board latching device for use with an insulative connector housing, said latching device comprising:

a main body portion;

a mounting member for mounting said main body portion to the housing including a generally horizontal support plate extending angularly outward from said main body portion, a first finger extending substantially downward from one end of said plate, and a second finger extending substantially downward from the opposite end of said plate, each respective first and second finger includes finger mounting portions;

a latch lug extending from said main body portion, said latch lug including a cam surface inclined relative to said main body portion and a lock surface substantially perpendicular to said main body portion; and a stress reducing member remote and independent from said mounting member, and including a resilient arm projecting angularly downward from proximate an upper portion of said main body portion.

* * * * *